US007780310B2

(12) United States Patent
Verfuerth et al.

(10) Patent No.: US 7,780,310 B2
(45) Date of Patent: Aug. 24, 2010

(54) MODULAR LIGHT FIXTURE WITH POWER PACK AND DEPLOYABLE SENSOR

(75) Inventors: Neal R. Verfuerth, Plymouth, WI (US); Kenneth J. Wetenkamp, Plymouth, WI (US); Ronald E. Ernst, Waldo, WI (US); Troy M. Johnson, St. Cloud, WI (US); Donald C. Heimerman, Random Lake, WI (US)

(73) Assignee: Orion Energy Systems, Inc., Manitowoc, WI (US)

( * ) Notice: Subject to any disclaimer, the term of this patent is extended or adjusted under 35 U.S.C. 154(b) by 269 days.

(21) Appl. No.: 12/172,888

(22) Filed: Jul. 14, 2008

(65) Prior Publication Data

US 2009/0009989 A1 Jan. 8, 2009

Related U.S. Application Data

(63) Continuation-in-part of application No. 11/771,331, filed on Jun. 29, 2007, which is a continuation-in-part of application No. 11/242,620, filed on Oct. 3, 2005, now Pat. No. 7,575,338.

(51) Int. Cl.
*F21S 8/04* (2006.01)

(52) U.S. Cl. ..... 362/221; 362/225; 362/217.08; 362/217.09; 362/147; 362/148

(58) Field of Classification Search ..... 362/221, 362/225, 217.08, 217.09, 411, 457, 458, 362/147, 148, 655, 260
See application file for complete search history.

(56) References Cited

U.S. PATENT DOCUMENTS

| | | | |
|---|---|---|---|
| 1,918,126 | A | 7/1933 | Peterson |
| D119,800 | S | 4/1940 | Carter, Jr. |
| D122,887 | S | 10/1940 | Beals |
| 2,306,206 | A | 12/1942 | Dalgleish |
| 2,312,617 | A | 3/1943 | Beck |
| D142,126 | S | 8/1945 | Sabatini |

(Continued)

OTHER PUBLICATIONS

Electrical Eng. Handbook: 14th Edition: McGraw Hill Pub. ISBN #0070220050; Editor Fink, et al. (pp. 26-56 —26-57).

(Continued)

*Primary Examiner*—Sharon E Payne
(74) *Attorney, Agent, or Firm*—Foley & Lardner LLP

(57) ABSTRACT

A light fixture includes a raceway, a lampholder, and a power pack. The raceway includes an aperture and a locking aperture. The lampholder is electrically connected to a lampholder connector. The power pack includes a power pack cover and a ballast and a deployable sensor. The deployable sensor includes a sensor head, a conduit and pivotable coupling that permits movement of the sensor between a deployed position and a stowed position. The power pack cover includes a latching end. The ballast includes a power input connector adapted to electrically connect to a power cord and a ballast output connector adapted to electrically connect to the lampholder connector. The latching end includes a flange adapted to mate with the aperture of the raceway and a locking protrusion adapted to mate with the locking aperture of the raceway such that the power pack is detachably mountable to the raceway.

20 Claims, 28 Drawing Sheets

U.S. PATENT DOCUMENTS

| | | | |
|---|---|---|---|
| 2,403,240 | A | 7/1946 | Sawin |
| D147,812 | S | 11/1947 | Picker |
| D150,735 | S | 8/1948 | Schwartz et al. |
| 2,619,583 | A | 11/1952 | Baumgartner |
| 2,636,977 | A | 4/1953 | Foster |
| 2,748,359 | A | 5/1956 | Swan |
| 3,247,368 | A | 4/1966 | McHugh |
| 3,337,035 | A | 8/1967 | Pennybacker |
| 3,390,371 | A | 6/1968 | Kramer |
| D217,615 | S | 5/1970 | Kress |
| 3,571,781 | A | 3/1971 | Gartland, Jr. et al. |
| 3,860,829 | A | 1/1975 | Fabbri |
| 4,001,571 | A | 1/1977 | Martin |
| 4,144,462 | A | 3/1979 | Sieron et al. |
| 4,146,287 | A | 3/1979 | Jonsson |
| 4,169,648 | A | 10/1979 | Moist, Jr. |
| D263,699 | S | 4/1982 | Vest et al. |
| 4,387,417 | A | 6/1983 | Plemmons et al. |
| 4,435,744 | A | 3/1984 | Russo |
| 4,443,048 | A | 4/1984 | Moist, Jr. |
| 4,544,220 | A | 10/1985 | Aiello et al. |
| 4,674,015 | A | 6/1987 | Smith |
| 4,690,476 | A | 9/1987 | Morgenrath |
| 4,701,698 | A | 10/1987 | Karlsson et al. |
| 4,708,662 | A | 11/1987 | Klein |
| 4,726,780 | A | 2/1988 | Thackeray |
| 4,749,941 | A | 6/1988 | Halder et al. |
| 4,814,954 | A | 3/1989 | Spitz |
| 4,834,673 | A | 5/1989 | Beinhaur et al. |
| 4,904,195 | A | 2/1990 | Thackeray |
| 4,907,985 | A | 3/1990 | Johnsen |
| 4,928,209 | A | 5/1990 | Rodin |
| 4,933,633 | A | 6/1990 | Allgood |
| D311,900 | S | 11/1990 | Esslinger |
| 5,013,253 | A | 5/1991 | Aiello et al. |
| 5,037,325 | A | 8/1991 | Wirkus |
| 5,062,030 | A | 10/1991 | Figueroa |
| 5,069,634 | A | 12/1991 | Chiarolanzio |
| 5,111,370 | A | 5/1992 | Clark |
| D329,919 | S | 9/1992 | Jahn |
| 5,192,129 | A | 3/1993 | Figueroa |
| 5,274,533 | A | 12/1993 | Neary et al. |
| 5,315,236 | A | 5/1994 | Lee |
| 5,320,560 | A | 6/1994 | Fladung |
| 5,342,221 | A | 8/1994 | Peterson |
| 5,349,289 | A | 9/1994 | Shirai |
| 5,357,170 | A | 10/1994 | Luchaco et al. |
| 5,371,661 | A | 12/1994 | Simpson |
| 5,377,075 | A | 12/1994 | Schmid et al. |
| 5,395,264 | A | 3/1995 | Keith |
| 5,462,452 | A | 10/1995 | Devine |
| D364,478 | S | 11/1995 | Pesau |
| D365,409 | S | 12/1995 | Lu |
| 5,473,522 | A | 12/1995 | Kriz et al. |
| 5,489,827 | A | 2/1996 | Xia |
| 5,616,042 | A | 4/1997 | Raby, Sr. et al. |
| D381,629 | S | 7/1997 | Goto |
| 5,673,022 | A | 9/1997 | Patel |
| 5,676,563 | A | 10/1997 | Kondo et al. |
| 5,727,871 | A | 3/1998 | Kotloff |
| 5,743,627 | A | 4/1998 | Casteel |
| D395,727 | S | 6/1998 | Thorton, Jr. |
| D399,019 | S | 9/1998 | Wilmotte |
| D402,763 | S | 12/1998 | Bring |
| 5,855,494 | A | 1/1999 | Blaszczyk et al. |
| 5,907,197 | A | 5/1999 | Faulk |
| 5,961,207 | A | 10/1999 | Petkovic |
| D416,542 | S | 11/1999 | Tsai |
| 6,024,594 | A | 2/2000 | Self, Jr. et al. |
| D425,860 | S | 5/2000 | Goto |
| 6,059,424 | A | 5/2000 | Kotloff |
| 6,091,200 | A | 7/2000 | Lenz |
| 6,102,550 | A | 8/2000 | Edwards, Jr. |
| D434,167 | S | 11/2000 | Foster |
| 6,151,529 | A | 11/2000 | Batko |
| 6,210,019 | B1 | 4/2001 | Weathers |
| D447,266 | S | 8/2001 | Verfuerth |
| D447,736 | S | 9/2001 | Nakashima et al. |
| 6,291,770 | B1 | 9/2001 | Casperson |
| 6,328,597 | B1 | 12/2001 | Epps |
| D460,735 | S | 7/2002 | Verfuerth |
| 6,420,839 | B1 | 7/2002 | Chiang et al. |
| D463,059 | S | 9/2002 | Verfuerth |
| D466,867 | S | 12/2002 | Krobusek |
| 6,496,756 | B1 | 12/2002 | Nishizawa et al. |
| 6,540,549 | B2 | 4/2003 | Rupert |
| 6,585,396 | B1 | 7/2003 | Verfuerth |
| D479,826 | S | 9/2003 | Verfuerth et al. |
| 6,644,836 | B1 | 11/2003 | Adams |
| D483,332 | S | 12/2003 | Verfuerth |
| 6,710,588 | B1 | 3/2004 | Verfuerth et al. |
| 6,724,180 | B1 | 4/2004 | Verfuerth et al. |
| 6,746,274 | B1 | 6/2004 | Verfuerth |
| 6,758,580 | B1 | 7/2004 | Verfuerth |
| 6,774,619 | B1 | 8/2004 | Verfuerth et al. |
| 6,979,097 | B2 | 12/2005 | Elam et al. |
| 7,282,840 | B2 | 10/2007 | Chih |
| 2002/0172049 | A1 | 11/2002 | Yueh |
| 2002/0189841 | A1 | 12/2002 | Patterson |
| 2003/0179577 | A1 | 9/2003 | Marsh |
| 2004/0076001 | A1 | 4/2004 | Lutes |
| 2005/0201088 | A1 | 9/2005 | Stach et al. |
| 2006/0232959 | A1 | 10/2006 | Hutchison et al. |
| 2008/0007943 | A1 | 1/2008 | Verfuerth et al. |
| 2008/0007944 | A1 | 1/2008 | Verfuerth et al. |
| 2009/0034263 | A1 * | 2/2009 | Stenback et al. ..... 362/296 |

OTHER PUBLICATIONS

Hazardous Locations Fluorescent Brochure, Hubbell Lighting, Inc., published 1994 (3 pages).

Photos of Hubbell Lighting Hazardous Locations Fluorescent Fixture (5 pages).

Day-Brite Lighting, 4' or 8' Assembly Line Luminaire Brochure, published 2000 (2 pages).

Day-Brite Lighting, Assembly Line Luminaire, 4 or 8 foot, 2 Lamp Slimline T8 or T12 High Output T8 or T12, Light Fixture Webpage, available at least by Apr. 19, 2005 (1 page).

Los Angeles Lighting Mfg. Co., SLA100 - Open Commercial, Ladder Arm Strip Brochure, published no. later than 2000 (3 pages).

Los Angeles Lighting Mfg. Co. Open Commercial, Ladder Arm Strip Webpage, published 1998 (1 page).

* cited by examiner

MODULAR LIGHT FIXTURE WITH POWER PACK AND DEPLOYABLE SENSOR

CROSS REFERENCE TO RELATED APPLICATIONS

The present Application claims the benefit of priority as a continuation-in-part of co-pending U.S. patent application Ser. No. 11/771,331 titled "Modular Light Fixture With Power Pack With Latching Ends" filed on Jun. 29, 2007, which is a continuation-in-part of U.S. patent application Ser. No. 11/242,620, titled "Modular Light Fixture With Power Pack" filed on Oct. 3, 2005, the disclosure of which are hereby incorporated by reference in their entirety.

FIELD

The subject of the disclosure relates generally to energy management and utilization in large commercial buildings, and more particularly to a modular light fixture apparatus including a power pack with a deployable sensor for monitoring an ambient lighting condition and/or the presence of occupants.

BACKGROUND

In large commercial buildings, recurring electricity costs for lighting can be more than half of the total energy budget. Consequently, there are considerable economic benefits to be obtained through more efficient lighting techniques. For example, simple devices such as motion sensor switches or light timers are often used to reduce wasted energy by reducing unnecessary lighting. Resources can also be conserved by replacing low efficiency ballasts and prolonging the operating lifetime of high efficiency ballasts and other light fixture components.

Many large commercial lighting applications depend heavily on fluorescent light fixtures driven by a ballast. The type of ballast determines, for example, the power consumption and optimal type of lamp to be used in the fixture. Along with characteristics of the light fixture itself, such as the geometry of the fixture, heat management, and the shapes of the reflectors, the choice of ballast and lamp largely determine the gross light production, expected maintenance interval, and energy consumption of the fixture. Consequently, effective lighting redeployment may require changing the ballast and/or type of lamp used in the fixture.

In a traditional light fixture, the ballast is generally hardwired within the light fixture, and the light fixture is hardwired to a building power supply. Thus, with the exception of changing the lamp, any maintenance and/or repairs to the light fixture may require the costly services of an electrician. Further, it can be expensive to move, replace, and/or modify an existing light fixture. As a result, existing light fixtures tend to remain in place even when they are obsolete or lighting requirements change, resulting in wasted electrical power and lost productivity due to ineffective lighting. Thus, there is a need for a light fixture which includes a detachable power pack such that the ballasts and other lighting components can be quickly replaced to achieve maximized energy savings. For example, a first power pack including a ballast with a ballast factor of 1.0 may be replaced by a second power pack including a ballast with a ballast factor of 0.75 to reduce power consumption of the light fixture. Further, there is a need for a detachable power pack with latching ends such that the detachable power pack can be securely mounted to and easily detached from the light fixture without the use of tools.

As known to those of skill in the art, ballasts used to supply power to light bulbs can produce a substantial amount of heat. This heat is mostly generated by metal-oxide semiconductor field-effect transistors (MOSFETs) and other electrical components within the ballast. Unfortunately, traditional light fixtures are limited in their ability to disperse the heat generated by ballasts. As a result, the entire light fixture can become hot and the risk of fire due to ballast overheating is increased. In addition, operating a ballast at an elevated temperature decreases the operating lifetime of the ballast, resulting in increased costs to replace ballasts. Further, high temperature operation results in less light energy output because light output is lower when the ballast components and lamps are hot. Thus, there is a need for a light fixture in which heat generated by the ballasts can be dispersed through convective, conductive, and/or radiative cooling.

There is also a need for a light fixture having a removable power pack with an integrally mounted deployable sensor (e.g. for monitoring ambient light level and/or the presence of occupants) that is readily and conveniently movable from a stowed condition (e.g. to facilitate storage, shipping/transport and installation) to a deployed condition (e.g. following installation of the fixture) for control and operation of the light fixture.

SUMMARY

An exemplary light fixture includes a raceway, a lampholder, and a power pack. The raceway includes an aperture and a locking aperture. The lampholder is electrically connected to a lampholder connector. The power pack includes a power pack cover and a ballast and a deployable sensor movable between a stowed position and a deployed position. The power pack cover includes a latching end. The ballast includes a power input connector adapted to electrically connect to a power cord and a ballast output connector adapted to electrically connect to the lampholder connector. The latching end includes a flange adapted to mate with the aperture of the raceway and a locking protrusion adapted to mate with the locking aperture of the raceway such that the power pack is detachably mountable to the raceway.

An exemplary method of providing a light fixture with a deployable sensor includes the steps of providing a light fixture having a pair of raceways, each coupled to one or more lampholders configured to receive a lamp, providing a power pack engagable with the raceways, providing a deployable sensor coupled to the power pack and movable between a stowed position and a deployed position, the deployable sensor including a sensor head, conduit and pivotable coupling, assembling power pack and deployable sensor to form an integral assembly, assembling the power pack to the raceways, positioning the deployable sensor in the stowed position; and shipping the assembly with the deployable sensor in the stowed position to a facility.

An exemplary power pack assembly for a light fixture includes a power pack cover including a latching end. The latching end includes a flange and a locking protrusion, where the flange is adapted to mate with an aperture in a raceway and the locking protrusion is adapted to mate with a locking aperture in the raceway such that the power pack cover is detachably mountable to the raceway. The power pack assembly also includes a ballast mounted to the power pack cover. The ballast includes a power input connector adapted to electrically connect to a power cord and a ballast output connector adapted to electrically connect to a lampholder connector. The power pack assembly also includes a deployable sensor mounted to the power pack cover for movement between a deployed position and a stowed position.

Other principal features and advantages will become apparent to those skilled in the art upon review of the following drawings, the detailed description, and the appended claims.

DETAILED DESCRIPTION

FIGS. 1-5 show various views of a fluorescent tube light fixture 10 for use in a method and apparatus according to an exemplary embodiment. As perhaps best shown in FIGS. 4-5, the fixture 10 includes a fixture body 66 and a detachable power pack 64.

Figure 2:
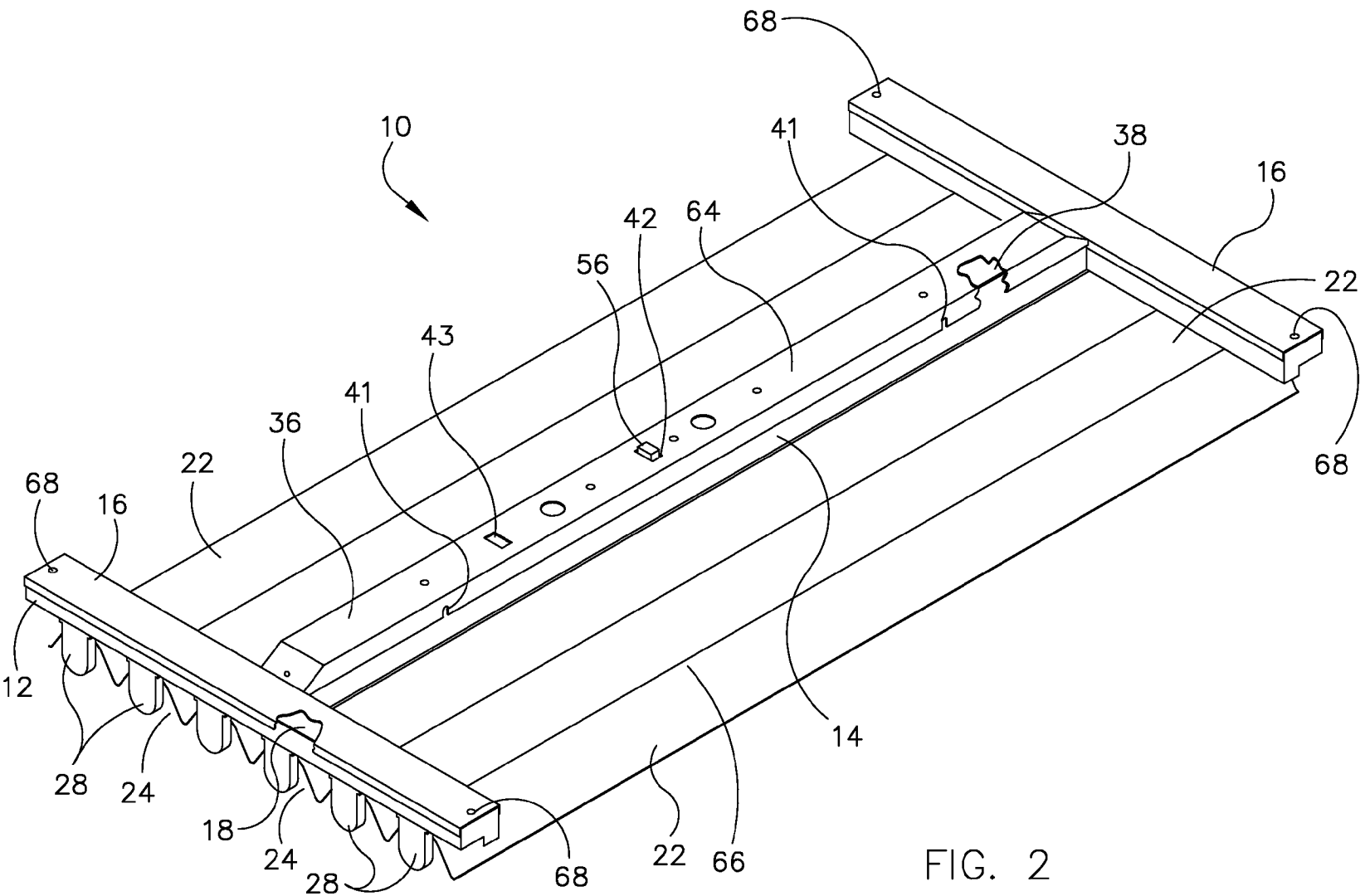
FIG. 2 is an assembled perspective view of the light fixture of FIG. 1 in accordance with an exemplary embodiment.
Figure 3:
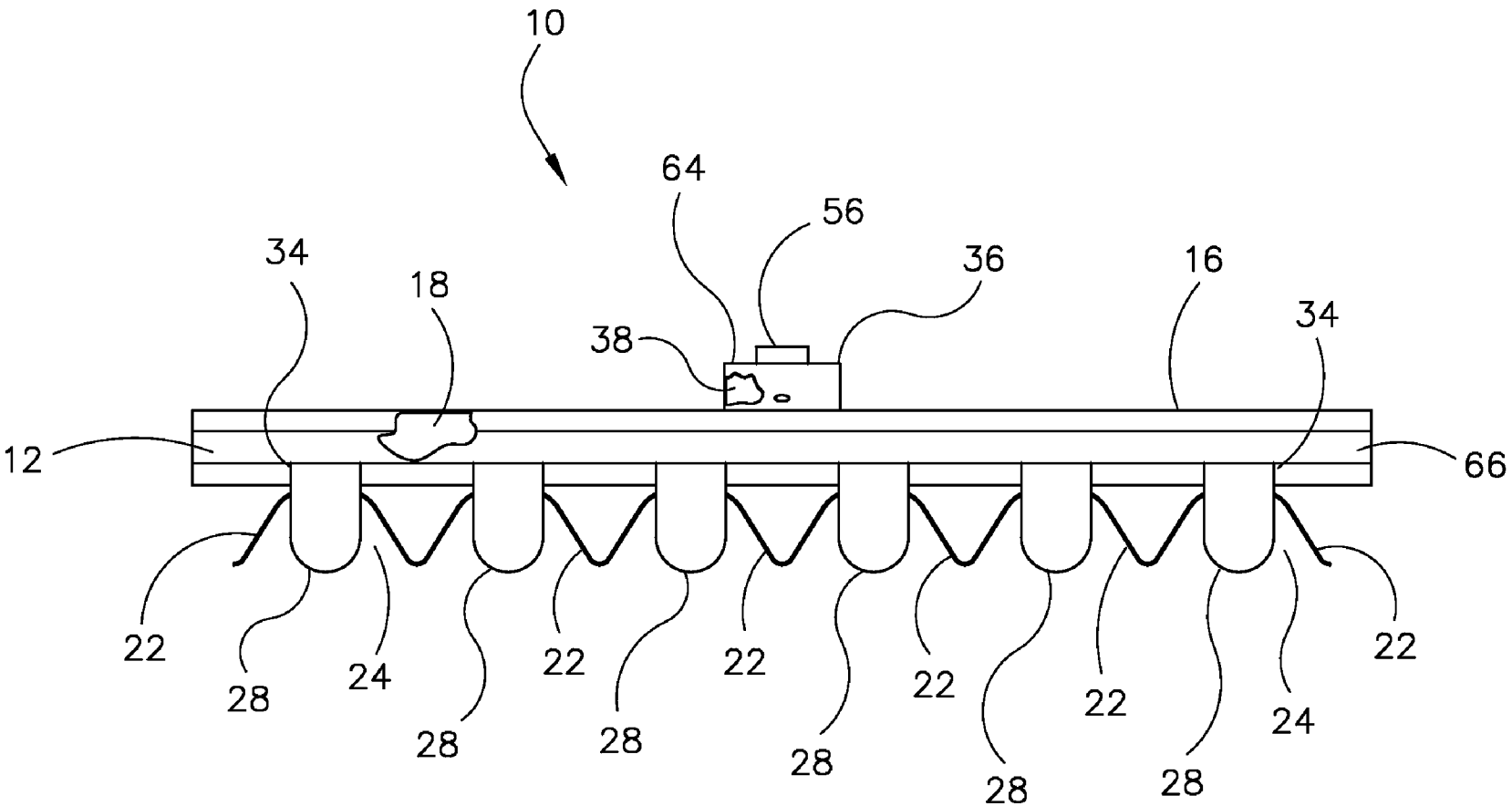
FIG. 3 is an end view of the light fixture of FIG. 1 in accordance with an exemplary embodiment.

The fixture body 66 includes a pair of raceways 12 connected by a ballast channel 14 to form a generally I-frame configuration. Each raceway 12 may be enclosed with a raceway cover 16, so that the raceway 12 and raceway cover 16 together form a raceway channel 18, as shown in FIGS. 2-3.

Each end of each raceway 12 may include a suspension point 68, for suspending the light fixture 10 above an area to be illuminated, for example using one or more chains connected between the suspension points 68 and the ceiling. The suspension points 68 may be located at or near the corners of the fixture, to ensure that the suspension hardware does not interfere with maintenance of the light fixture including, but not limited to, replacement of the detachable power pack 64.

One or more light reflectors 22 are secured to each of the raceways 12 such as by rivets, bolts, screws or the like. Six reflectors are shown in the drawings, however, it should be noted that any number of light reflectors can be used. Each light reflector 22 can be fabricated from a single piece of material or can be fabricated of individual pieces of material. Any exposed edges of the light reflectors 22 may be folded back (hemmed) to reduce sharp edges and improve safety. In the exemplary embodiment of FIG. 1, each light reflector 22 defines a reflector channel 24 adapted to house a lamp 30 (not shown in FIGS. 1-5). In an exemplary embodiment, lamp 30 is a fluorescent tube lamp. In an alternative embodiment, a metal halide lamp, a sodium lamp, or any other type of discharge lamp known to those of skill in the art can be used.

The fixture body 66 includes lampholder harnesses 26 housed in the two raceway channels 18 at the opposite ends of the light fixture. Each lampholder harness 26 includes one or more lampholders (sockets) 28 and a lampholder harness connector 32. Each lampholder 28 may extend through a corresponding aperture 34 in a raceway 12 adjacent to the end of a reflector channel 24. In normal operation, a single fluorescent tube lamp extends between a pair of lampholders 28 at opposite ends of each reflector channel 24.

Figure 4:
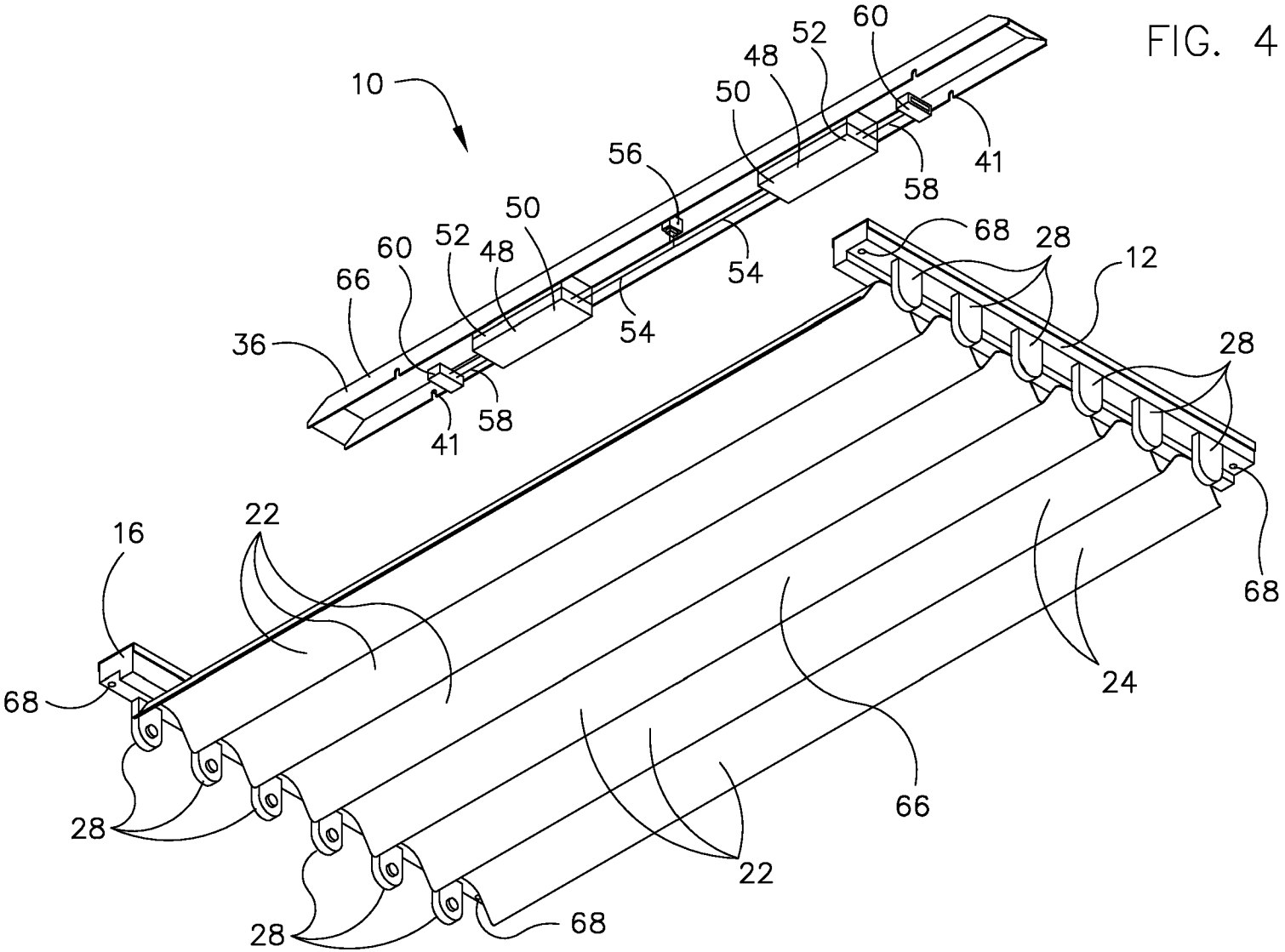
FIG. 4 is a perspective view from below the light fixture of FIG. 1, with a detachable power pack separated from the body of the light fixture in accordance with an exemplary embodiment.

With reference to FIG. 4, the detachable power pack 64 of the light fixture 10 may include a ballast channel cover 36, one or more ballasts 48, power input wiring 54, a modular power input connector 56, ballast output wiring 58, and a modular ballast output connector 60. The detachable power pack 64 may be detachable from the light fixture body 66 without the use of tools, and without any interference from the suspension hardware.

Figure 5:
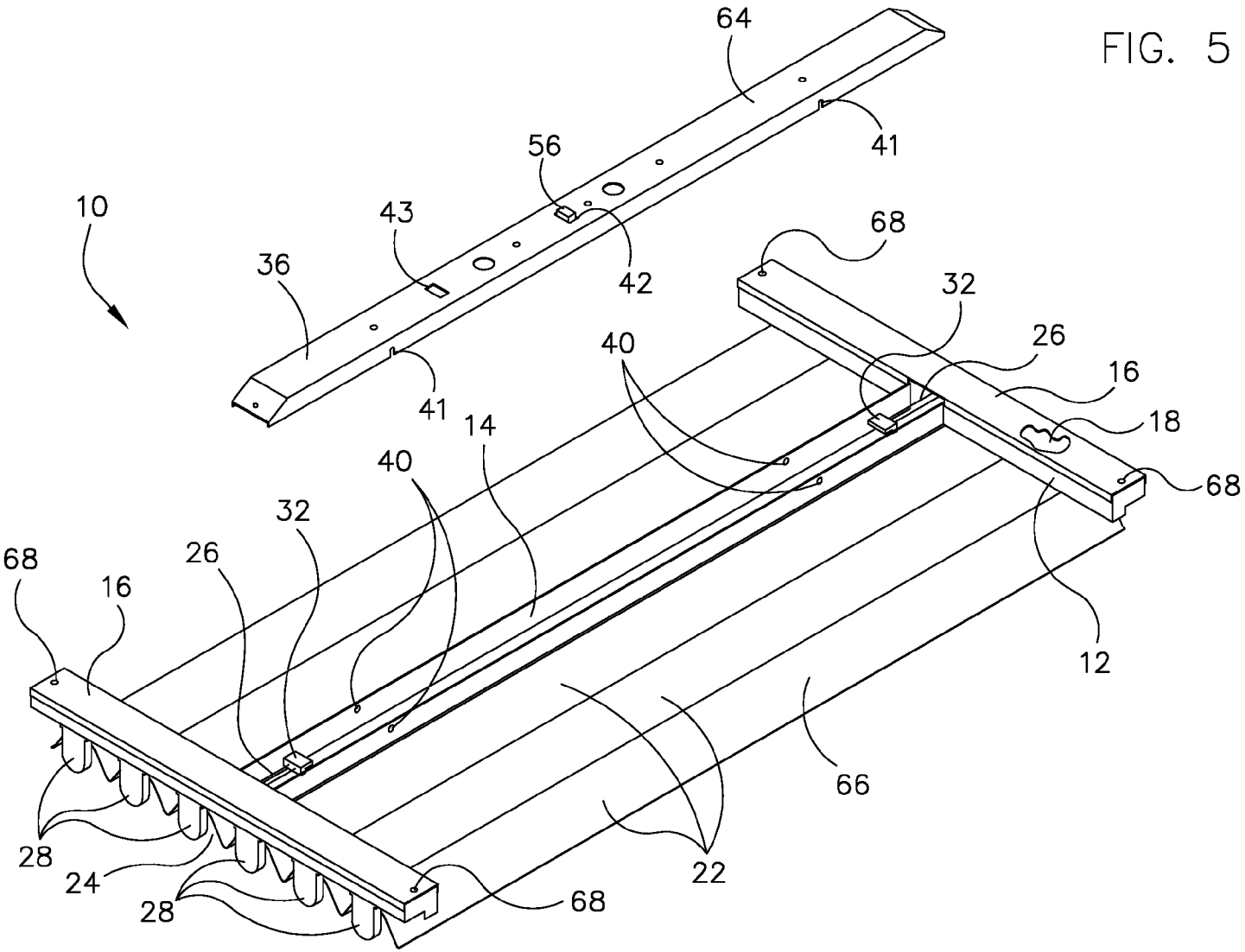
FIG. 5 is a perspective view from the side of the light fixture of FIG. 1, with the detachable power pack separated from the body of the light fixture in accordance with an exemplary embodiment.

With reference to FIGS. 2 and 5, the ballast channel cover 36 of the detachable power pack 64 engages the ballast channel 14 of the fixture body 66 to define a ballast chamber 38. The ballast channel cover 36 can include cover clip portions 41 which mate with corresponding body clip portions 40 to detachably attach the ballast channel cover 36 to the ballast channel 14. The clips provide an interference or frictional fit to allow separation without the use of tools. However, this is not required, and other means, such as screws, could be used to detachably attach the detachable power pack 64 to the fixture body 66. In an exemplary embodiment, detachable power pack 64 can include latching ends (or flanges) adapted to mate with apertures in the raceways 12. The latching ends are described in more detail with reference to FIGS. 12-15.

The ballast channel cover may include a power line connector aperture 42 adapted to receive a modular power input connector 56, and a feature connector aperture 43 adapted to receive a feature connector (not shown). The modular power input connector 56 may be a polarized modular power input socket 210 configured for the available electrical power supply voltage and configuration, as discussed in more detail below with reference to FIGS. 9-10. However, this is not required, and other methods can be used to supply electrical power to the fixture, as discussed in more detail below with reference to FIGS. 6(*a*)-6(*c*).

The exemplary detachable power pack 64 of the light fixture 10 includes two ballasts 48, for example a model 49776 electronic ballast available from GE Lighting of Cleveland, Ohio. However, this is not required, and other makes and models of ballasts can be employed. Further, while the exemplary light fixture 10 includes two ballasts 48, a greater or lesser number of ballasts 48 can be used.

Each ballast 48 has a first (input) end 50 and a second (output) end 52. Power input wiring 54 electrically connects the modular power input connector 56 to the first end 50 of each ballast 48. As discussed in more detail below with reference to FIGS. 9-10, the modular power input connector 56 mates with a modular power cord assembly 180 supplying electrical power. The modular power cord assembly 180 may be quickly and easily disconnected from the modular power input connector 56 without the use of tools, in order to verifiably and positively remove electrical power from the fixture to reduce the risk of electrical shock during maintenance.

Ballast output wiring 58 electrically connects the second (output) end 52 of each ballast 48 to a modular ballast output connector 60. The modular ballast output connector 60 mates with a corresponding lampholder harness connector 32. The modular ballast output connector 60 may be quickly and easily disconnected from the lampholder harness connector 32 without the use of tools.

Each ballast 48 is fastened to the ballast channel cover 36, for example using threaded fasteners, to engage mounting ears 62 on each ballast 48 through holes in the ballast channel cover 36. However, threaded fasteners are not required and other means can be utilized to fasten each ballast 48 to the ballast channel cover 36, such as adhesives or interference mounting techniques.

When the ballast 48 is secured to the ballast channel cover 36, the modular power input connector 56 may extend through the aperture 42 for connection to a modular power cord assembly 180 (not shown in FIGS. 1-5). The ballast channel cover 36 is positioned above the ballast 48, with good thermal contact between the ballast 48 and ballast channel cover 36, so waste heat generated by the ballast 48 conducts upwardly to the ballast channel cover 36. The ballast channel cover 36 is positioned at the top of the fixture 10, and exposed to air circulation so waste heat from the ballast can convect and radiate away from the light fixture.

Figure 1:
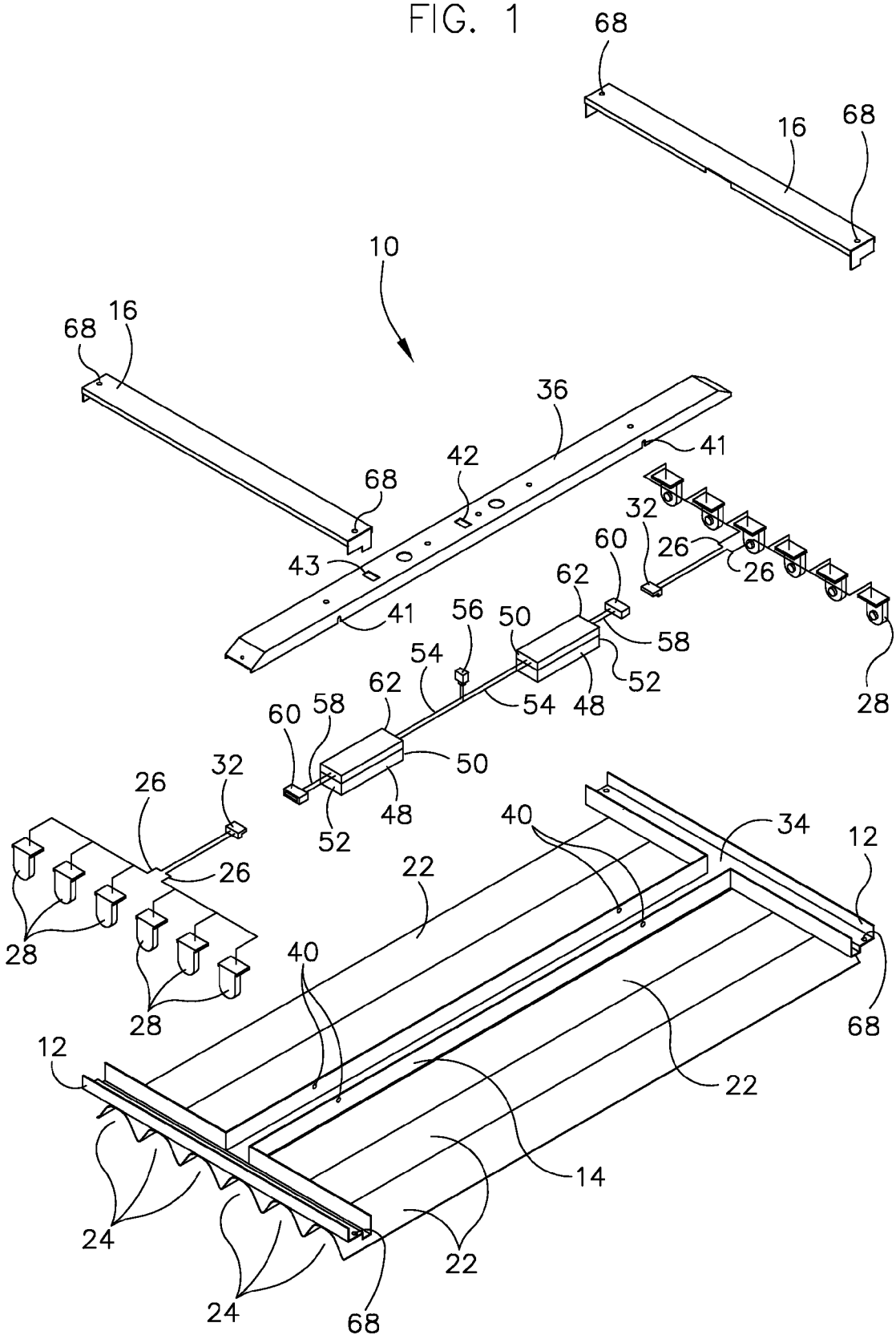
FIG. 1 is an exploded perspective view of a light fixture in accordance with an exemplary embodiment.

In the exemplary embodiment shown with reference to FIG. 1, when the detachable power pack is attached to the fixture body 66, each ballast 48 is housed in the ballast chamber 38, and oriented so that the modular ballast output connectors 60 of the power pack 46 can mate with the modular lampholder harness connectors 32 of the lampholder harnesses 26. When the modular ballast output connectors 60 mate with the modular lampholder harness connectors 32, the ballasts 48 are electrically connected to deliver power to the lampholder harnesses 26, the lampholders 28, and the lamps 30 (not shown in FIGS. 1-5). Suitable mating modular ballast output connectors 60 and modular lampholder harness connectors 32 are a male and female connector pair available as models 231-604 and 231-104/02600 from Wago Corp. of Germantown, Wis. However, this is not required and other types, makes and models of mating modular connectors can be used.

FIGS. 4 and 5 are perspective views of the light fixture of FIG. 1, with the detachable power pack 64 separated from the fixture body 66 of the light fixture 10. The following discussion of exemplary methods for modifying or servicing a light fixture is not meant to be limiting as alternative methods may be used. Replacing the detachable power pack 64 in a light fixture 10, for example to change the ballast characteristics in response to changing light requirements or to service a failed ballast, is straightforward and does not necessarily require a high level of skill or the use of tools.

In an exemplary embodiment, the modular power cord 180 is disconnected from the modular power input connector 56, thereby positively and verifiably cutting off electrical power from the light fixture 10 to improve the safety of the procedure. The old detachable power pack 64 is separated from the body 66 of the light fixture by uncoupling the cover clip portions 41 from the body clip portions 40, and by disconnecting the modular ballast output connectors 60 from their corresponding lampholder harness connectors 32. The old power pack 64 can be set aside for eventual repair, recycling, or disposal.

When reassembling the light fixture 10 with a new or replacement power pack 64, the reverse of the above procedure is performed. The ballast output connectors 60 on the new power pack 64 are mated with their corresponding lampholder harness connectors 32, and the new power pack 64 is detachably fastened to the body 66 of the light fixture by coupling the cover clip portions 41 with the body clip portions 40. Modular power cord 180 is reconnected to the modular power input connector 56 to restore power to the light fixture 10 for normal operation.

It should be noted that the detachable power pack can be used with other light fixtures, and is not meant to be limited to use with the light fixture shown and described herein. For example, another fluorescent tube light fixture embodiment in which the detachable power pack can be employed is that shown and described in U.S. Pat. No. 6,585,396, the entire contents of which are hereby incorporated by reference.

Figure 6A:
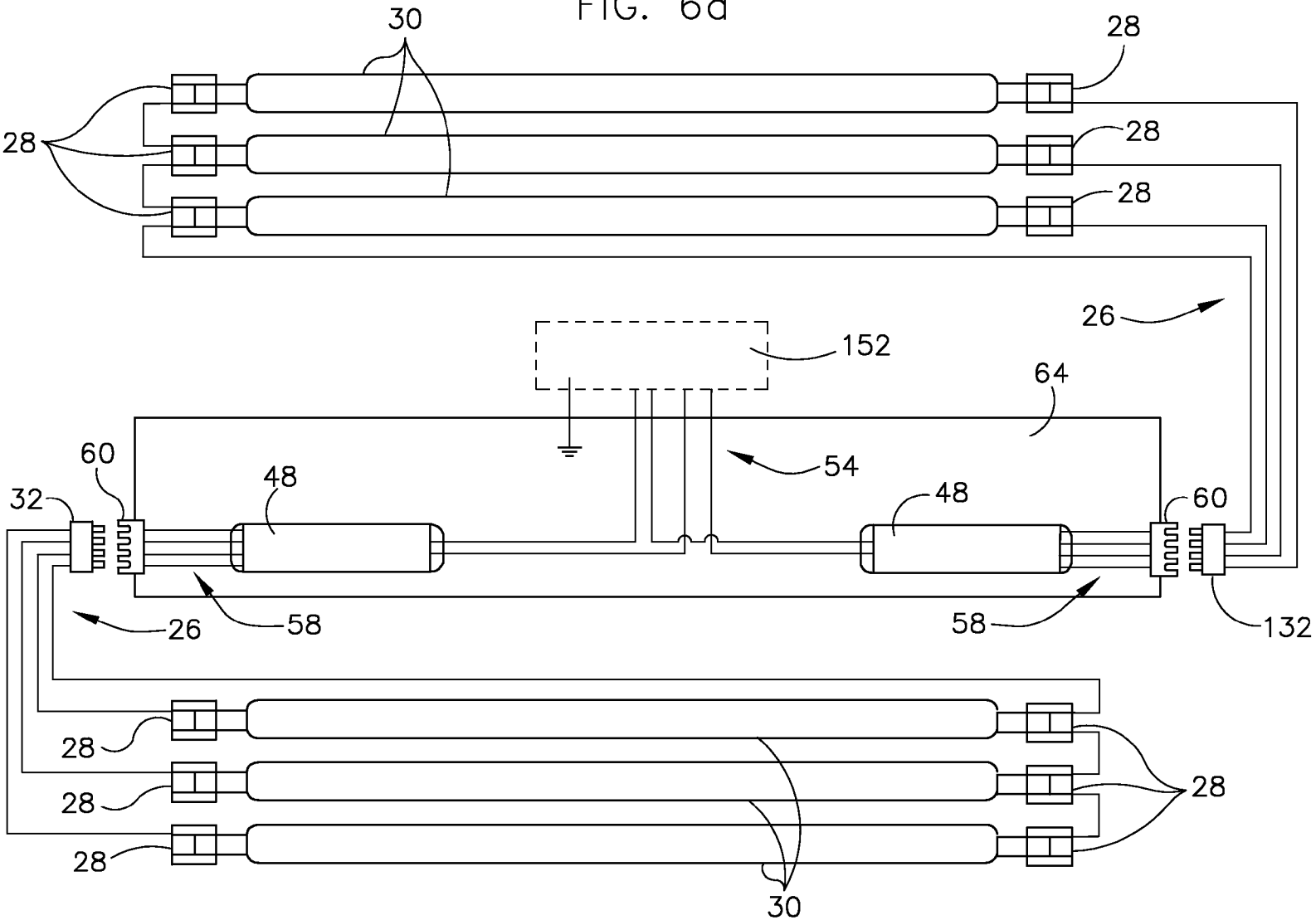
FIGS. 6(*a*)-6(*c*) are circuit diagrams in accordance with exemplary embodiments for light fixtures having detachable ballast assemblies with hard-wired, armored whip, and modular connector input power configurations, respectively.
Figure 6B:
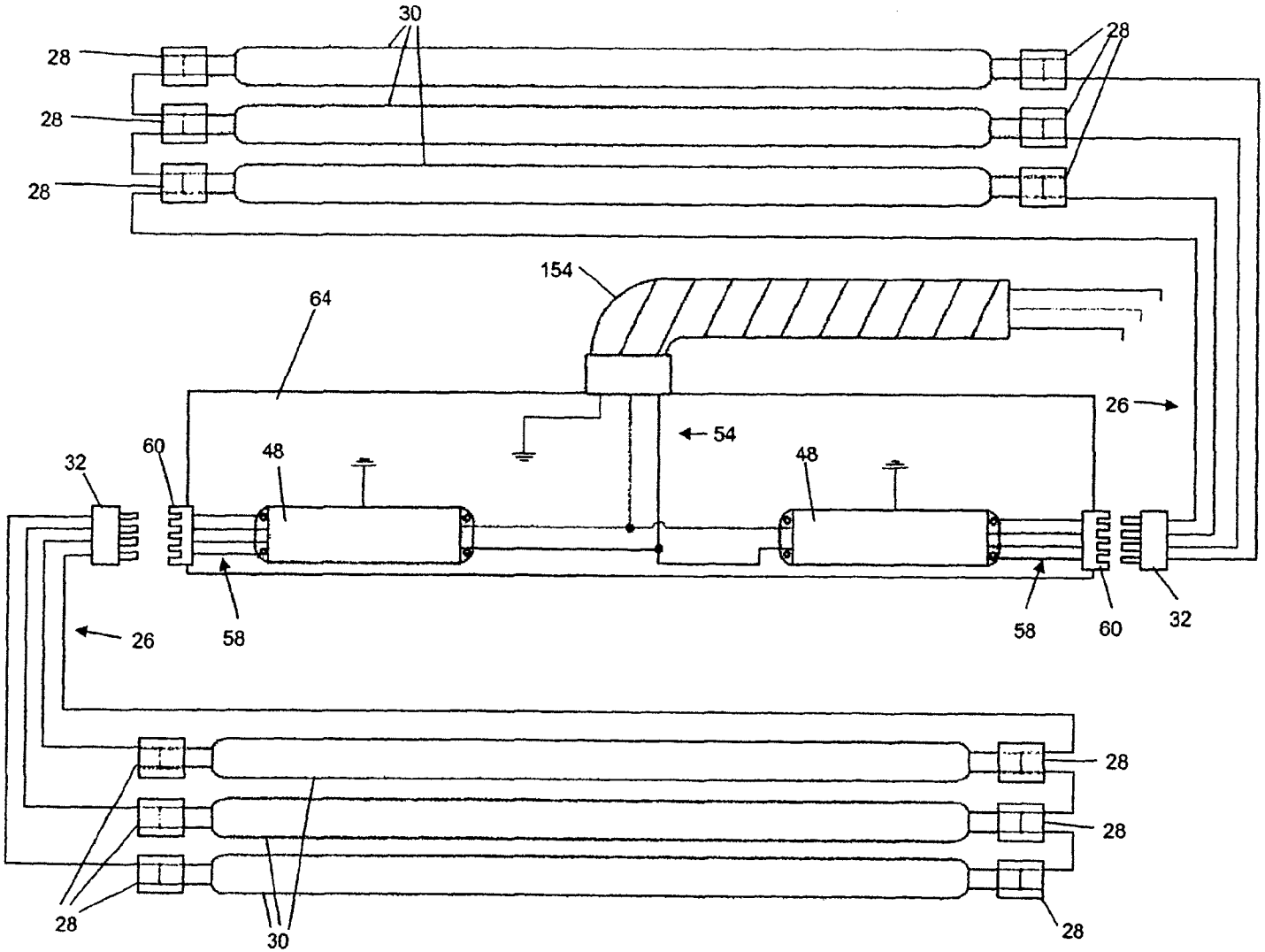
Figure 6C:
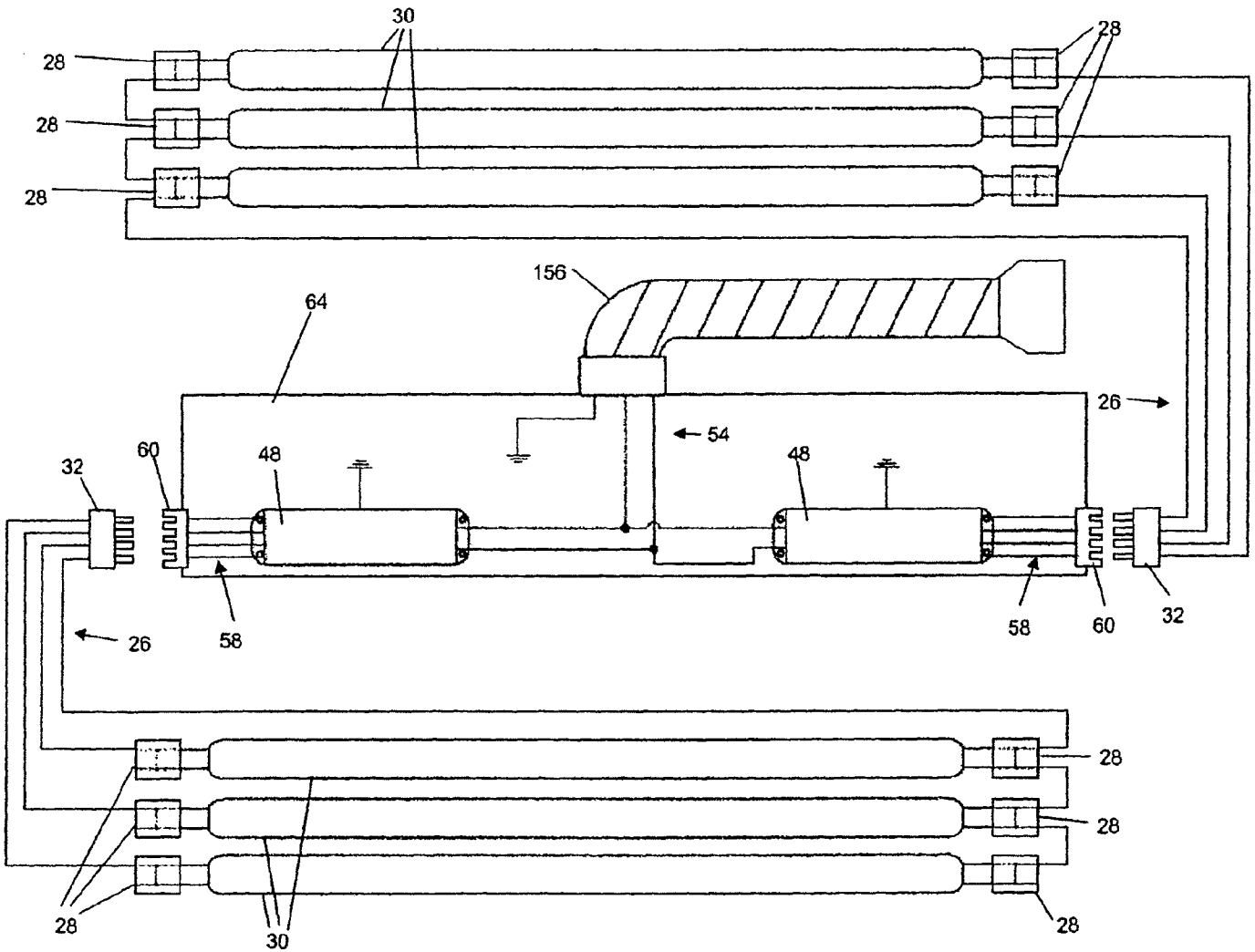
Figure 7A:
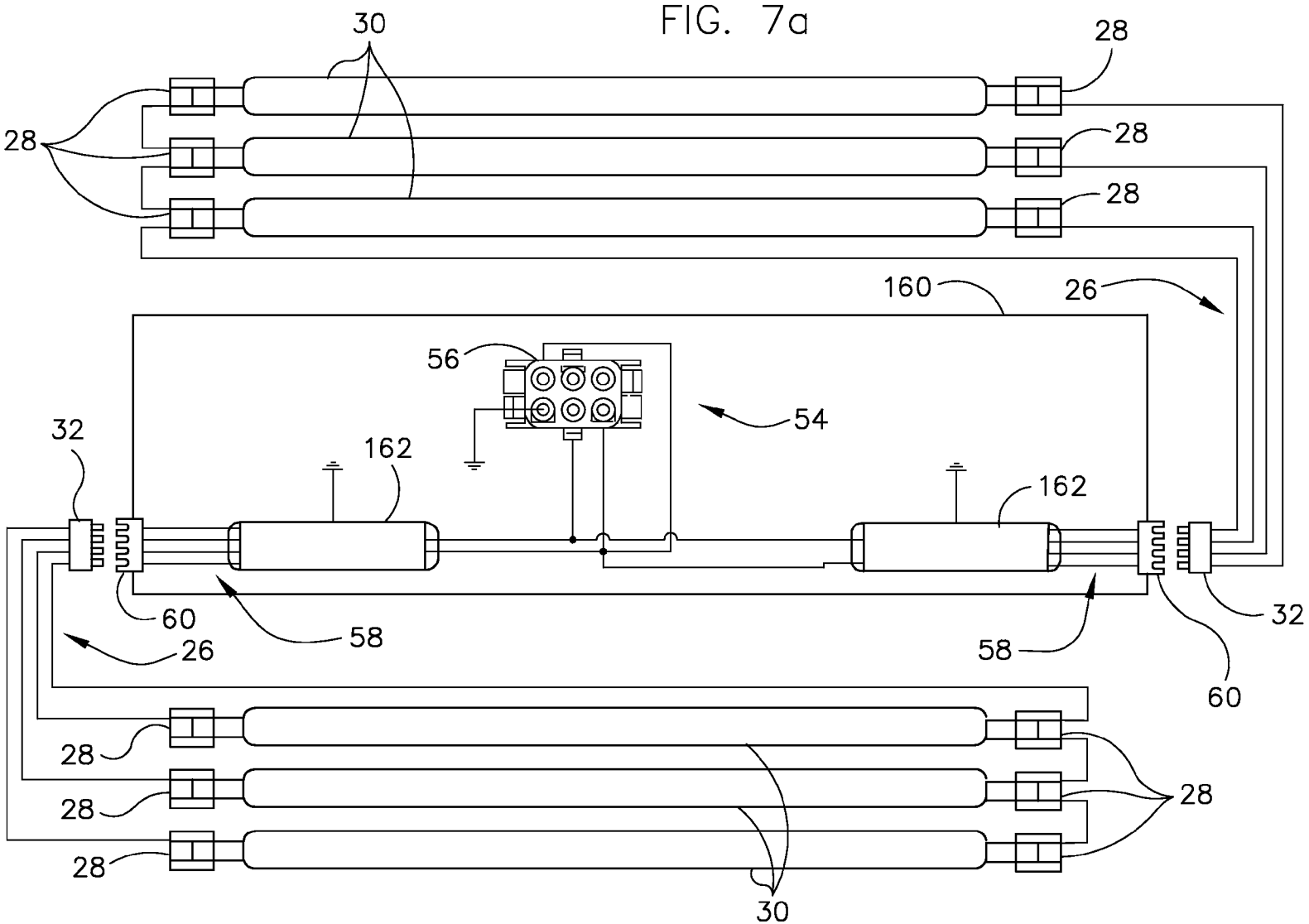
FIGS. 7(*a*)-7(*e*) are circuit diagrams in accordance with exemplary embodiments for light fixtures having detachable ballast assemblies with normal ballast factor, low ballast factor, high ballast factor, dual switch/high ballast factor, and battery backup/high ballast factor configurations, respectively.
Figure 7B:
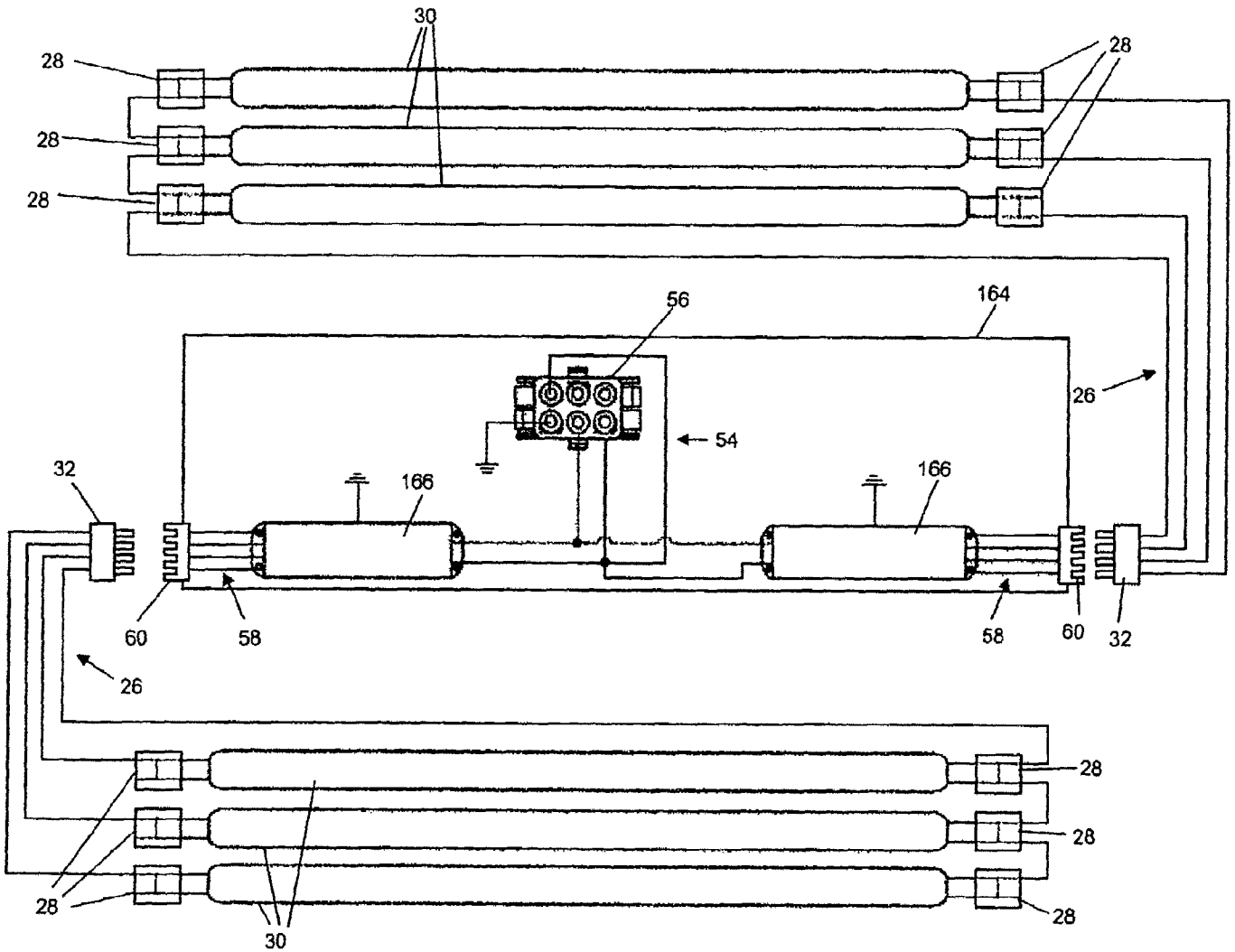
Figure 7C:
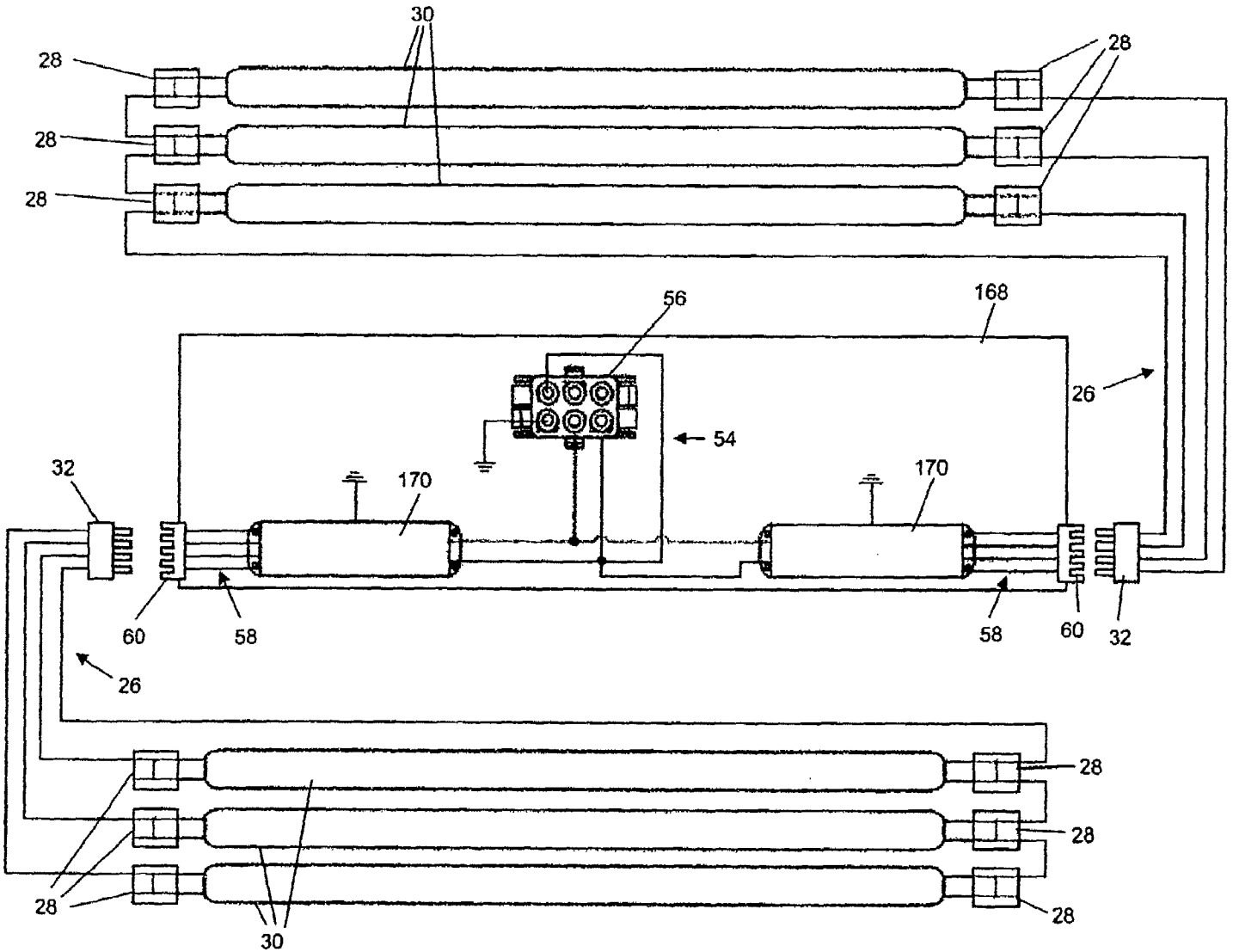
Figure 7D:
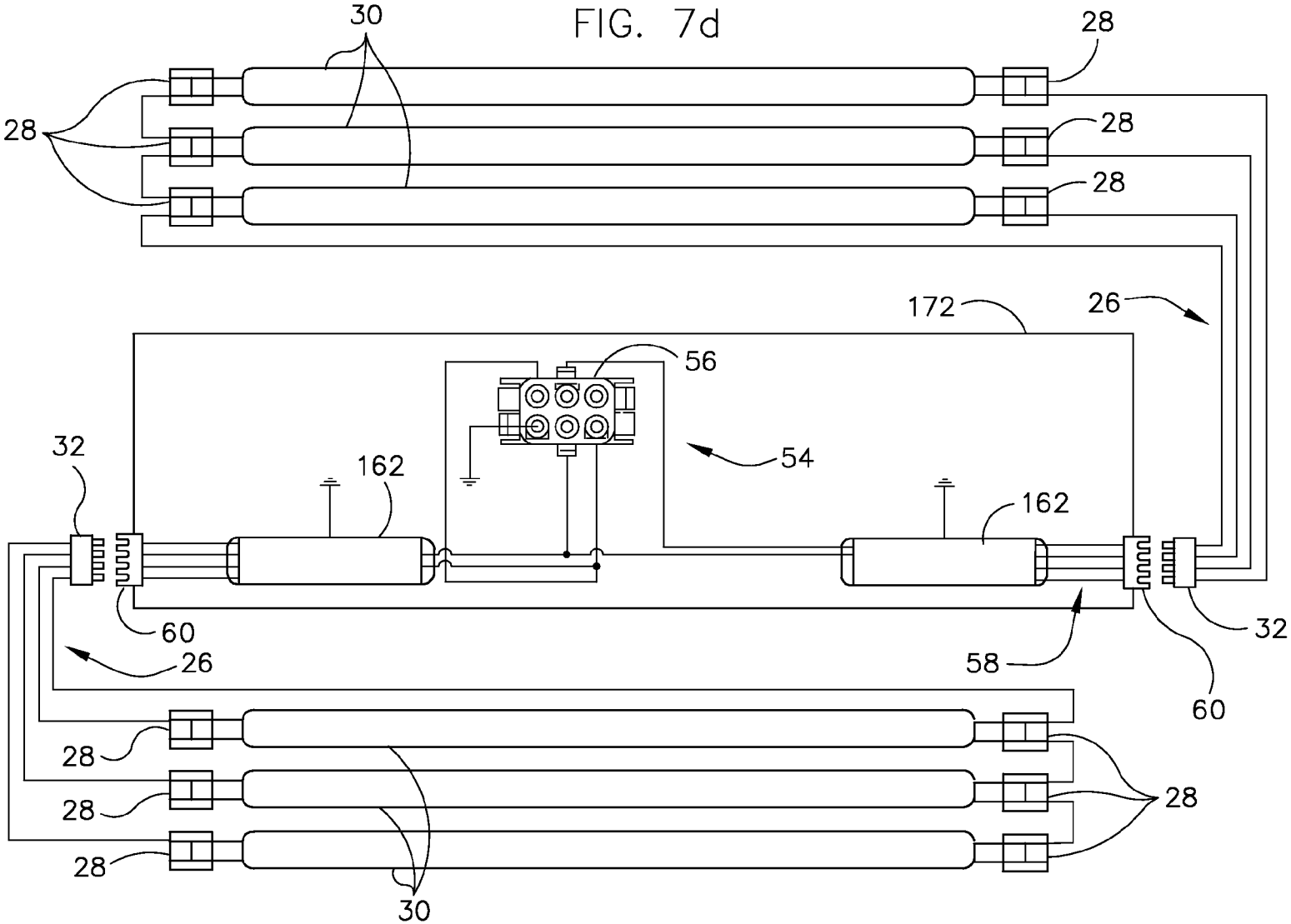
Figure 7E:
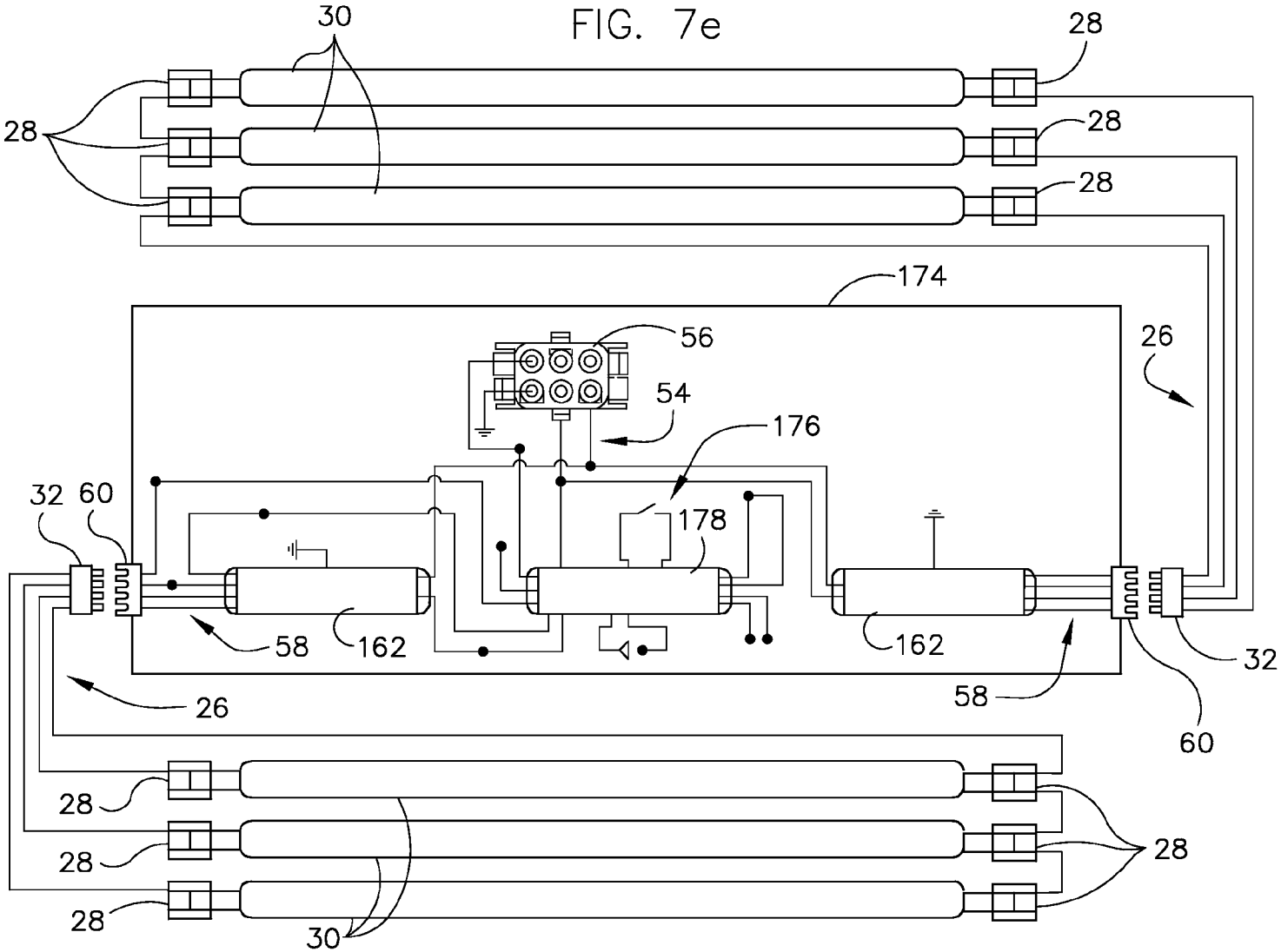

FIGS. 6(*a*)-6(*c*) are circuit diagrams for light fixtures having detachable ballast assemblies with alternative input power configurations in accordance with exemplary embodiments. A variety of alternative input power configurations can be provided to allow a light fixture to be used with a variety of available power sources. These alternative input power configurations can be classified generally into "hard wire" configurations, and "modular" configurations. A light fixture according to an exemplary embodiment can include either input power configuration.

FIGS. 6(*a*) and 6(*b*) show examples of hard wire input power configurations. The detachable power pack 64 of FIG. 6(*a*) includes a hard wire power supply connector 152. The hard wire power supply connector 152 represents a connection which is hard wired directly to a branch circuit in the building, for example by an electrician. The detachable power pack 64 of FIG. 6(*b*) includes one type of hard wire power supply connector, an armored whip power supply line 154.

The detachable power pack 64 of FIG. 6(*c*) includes a modular wiring system power supply line 156. An alternative, "daisy chain" modular wiring system power supply line is described, for example, in U.S. Pat. No. 6,746,274, the entire contents of which are hereby incorporated by reference.

While the exemplary circuit diagrams of FIGS. 6(*a*)-6(*c*), and the disclosure of U.S. Pat. No. 6,746,274 show specific combinations of input power configurations with particular types of ballasts, these specific combinations are not required. It should be understood that any of these input power configurations can be used with a light fixture based on the environment in which the light fixture is to be installed. It should also be understood that any of these power supply configurations can be used with any type of ballast, not just the particular types of ballasts shown in FIGS. 6(*a*)-6(*c*).

FIGS. 7(*a*)-7(*e*) are circuit diagrams for light fixtures having detachable ballast assemblies with alternative ballast configurations in accordance with exemplary embodiments. Advantageously, such a variety of alternative ballast configurations can allow a light fixture to provide a wider variety of light levels at varying power consumption levels.

The detachable power pack of FIG. 7(*a*) is a high ballast factor detachable power pack 160 that includes a high ballast factor ballast 162. The detachable power pack of FIG. 7(*b*) is a normal ballast factor detachable power pack 164 that includes a normal ballast factor ballast 166. The detachable power pack of FIG. 7(*c*) is a low ballast factor detachable power pack 168 that includes a low ballast factor ballast 170. The detachable power pack of FIG. 7(*d*) is a dual switched detachable power pack 172 that includes two high ballast factor ballasts 162 that receive independent power on separate lines from the modular power input connector 56. The detachable power pack of FIG. 7(*e*) is a battery backup detachable power pack 174 that includes battery backup circuitry 176, a battery backup ballast 178, and two high ballast factor ballasts 162. The battery backup ballast 178 can supply lighting in the event of a failure of the main electrical supply, for example in the case of a natural disaster or fire.

Figures 8A, 8B, 8C:
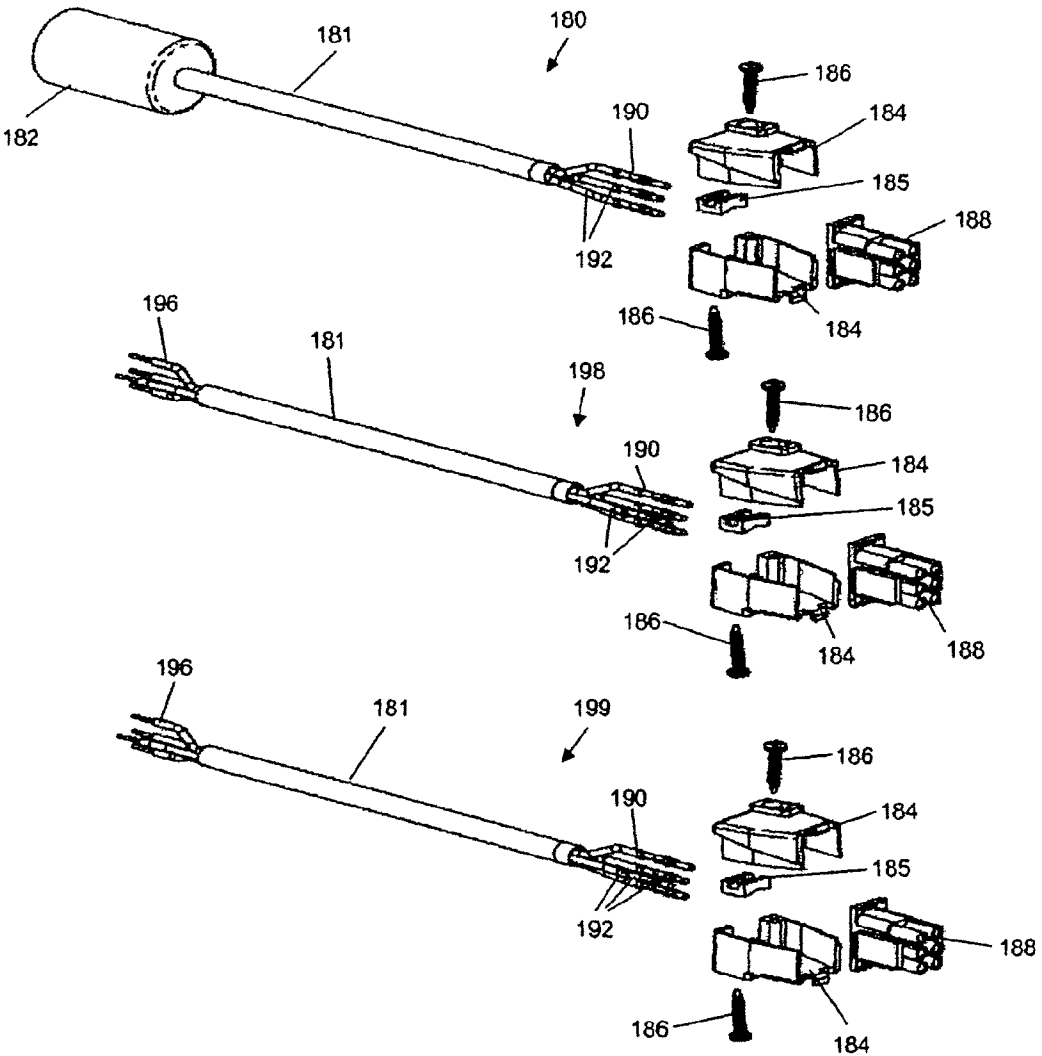
FIGS. 8(*a*)-8(*c*) are perspective views of exemplary modular power supply cords.

FIG. 8(*a*) shows a modular power cord assembly 180 having a first end that terminates in a polarized modular power supply plug, and a second end that terminates in a conventional power plug 182. The modular power cord assembly 180 includes a suitable length of conventional insulated power cord 181 with 3 or 4 insulated conductors surrounded by an insulated jacket. The power cord 181 can be any standard electrical power cord having suitable power handling and other specifications, for example 18 gauge 3-conductor or 18 gauge 4-conductor power cord can be used. In an exemplary embodiment, a variety of cord lengths, for example from 3' to 35' in length, are kept in stock, allowing the appropriate cord length to be chosen from stock at the time the light fixture is installed, without requiring any delay for custom manufacturing of a modular power supply cord having the appropriate length.

In an exemplary embodiment, the polarized modular power supply plug is a 6-pin "Mate-N-Lock" plug connector of the type sold by the AMP division of Tyco Electronics of Harrisburg, Pa. However, this is not required and other types, makes and models of modular power supply connectors can be used. The polarized modular power supply plug 158 can include strain relief, for example two strain relief pieces 184 and a plastic insert 185 (such as AMP P/N 640715-1), and a plug body 188. The strain relief 184, plastic insert 185, and plug body 188 can be held together with screws 186, such as #6×⅝" sheet metal screws.

In an exemplary embodiment, the plug body 188 has six positions for holding electrical pins, although a plug body having a greater or lesser number of pin positions can be used. A short portion of the insulation is stripped from the end of each conductor in the electrical cord 181, and an electrical pin is electrically and mechanically connected to the stripped portion. The electrical pins and attached conductors are then inserted into specific pin positions in the plug body 188 to form a polarized modular power supply plug, as discussed in more detail with reference to FIGS. 10(*a*)-10(*j*).

The "extra long" electrical pin 190 used for the green (safety ground) line is generally slightly longer than the "standard length" electrical pins 192 used for the black (power supply or "hot"), white (power return or neutral), and red (switched power) lines. This helps ensure that the safety ground connection is made first and broken last when the plug 158 is inserted into or removed from its corresponding socket. A suitable extra long electrical pin 190 for the safety ground would be AMP PN 350669, and a suitable standard length electrical pin 192 for the other lines would be AMP PN 350547-1.

The conventional power plug 182 can be any standard electrical plug configuration, such as a NEMA 5, NEMA L5, NEMA L7, NEMA 6, or NEMA L6 plug. In an exemplary embodiment, a variety of plug configurations are kept in stock, allowing the appropriate plug configuration to be chosen from stock at the time the light fixture is installed, without requiring any delay for custom manufacturing of a modular power supply cord having the appropriate plug configuration.

FIG. 8(*b*) shows an alternative modular power cord assembly 198 having a first end that terminates in a polarized modular power supply plug, and a second end that terminates in stripped conductors 196. The stripped conductors may be about ⅜" in length. The modular power cord assembly 198 is similar in construction to the modular power cord assembly 180, except that the modular power cord assembly 198 terminates in stripped conductors 196 that can be used, for example, to hardwire the fixture to building power, and the modular power cord assembly 198 is wired for "universal" application. FIG. 8(*c*) shows a "dual switch" modular power cord assembly 199 that is otherwise similar in construction to the modular power cord assembly 198.

Figure 9:
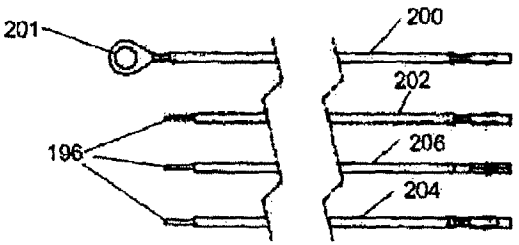
FIG. 9 presents plan views of the components of exemplary power input wiring.
Figure 10A:
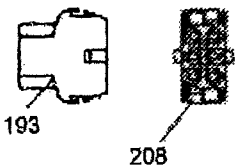
FIGS. 10(*a*)-10(*j*) show exemplary pin assignments for the input power plug and socket connectors in various configurations.
Figure 10A:
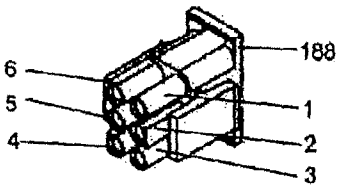
Figure 10B:
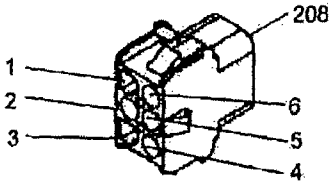
Figure 10C:
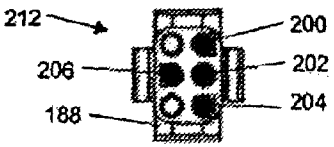
Figure 10D:
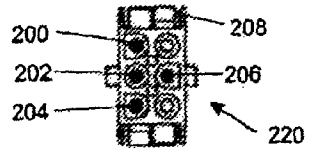
Figure 10E:
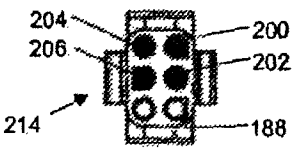
Figure 10F:
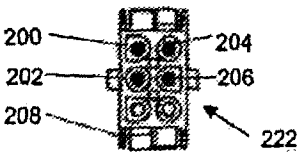
Figure 10G:
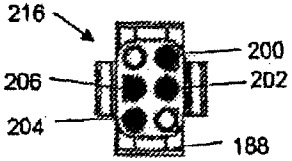
Figure 10H:
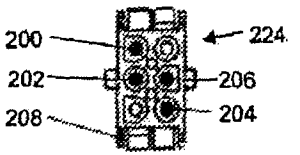
Figure 10I:
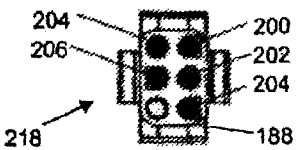
Figure 10J:
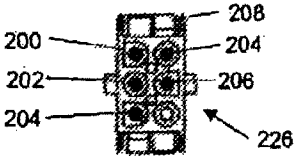

FIG. 9 shows exemplary power input wiring 54 for a detachable power pack in a light fixture in accordance with an exemplary embodiment. The exemplary power input wiring 54 includes at least 3 insulated conductors, including a safety ground (green) wire 200, a power return (white) wire 202, and a power supply (black) wire 204. Depending on the application, the power input wiring 54 may also include a switched power (red) wire 206, and a second power supply (black) wire 204. Each conductor is made of a suitable length of insulated wire, for example UL 1015 18 AWG wire rated for 105° C. and 600V can be used.

One end of the power input wiring terminates in a modular power input connector 56, which may be a polarized modular power input socket 210 such as a 6-pin "Mate-N-Lock" socket connector of the type sold by the AMP division of Tyco Electronics of Harrisburg, Pa.

In an exemplary embodiment, the polarized modular power input socket 210 includes a socket body 208 having six positions for holding single conductor sockets, although a socket having a greater or lesser number of single conductor socket positions could be used. A short portion of the insulation is stripped from the end of each conductor, and a single conductor socket 193, for example AMP PN 350550-1, is electrically and mechanically connected to the stripped portion, for example by crimping and/or soldering. The single conductor socket 193 and attached conductor are then inserted into a specific single conductor socket position in the socket body 208 to form the polarized modular power input socket 210, as discussed in more detail with reference to FIGS. 10(*a*)-10(*j*).

FIGS. 10(*a*)-10(*j*) show exemplary pin assignments for the input power plug and socket connectors in various configurations of a detachable power pack for use in a light fixture. However, these pin assignments are not required, and other pin assignments can be used. FIGS. 10(*a*)-10(*j*) also show a convention for numbering the pins 1-6 in the input power plug and socket connectors.

FIGS. 10(*a*)-10(*j*) illustrate an exemplary 120V power supply configuration. The exemplary 120V power supply configuration uses a 120V modular power supply plug 212 along with a 120V modular power input socket 220. The plug 212 and socket 220 each include at least a safety ground (green) wire 200, a power return (white) wire 202, and a power supply (black) wire 204 located at specific positions in plug head 188 and socket head 208, respectively. When used in a 120V dual-switched configuration, the plug 212 and socket 220 also include a second power (red) wire 206.

FIGS. 10(*e*) and 10(*f*) illustrate an exemplary 277 V power supply configuration. The exemplary 277V power supply configuration uses a 277V modular power supply plug 214 along with a 277V modular power input socket 222. Like the 120V plug 212 and 120V socket 220, the 277V plug 214 and the 277V socket 222 each include at least a safety ground (green) wire 200, a power return (white) wire 202, and a power supply (black) wire 204. The safety ground (green) wire 200 and the power return (white) wire 202 of the 277V configuration are at the same pin positions as in the 120V configuration, however the power supply (black) wire 204 is at a different pin position. When used in a 277V dual-switched configuration, the plug 214 and socket 222 also include a second or switched power (red) wire 206.

FIGS. 10(*g*) and 10(*h*) illustrate an exemplary 347/480V power supply configuration. The exemplary 347/480V power supply configuration uses a 347/480V modular power supply plug 216 along with a 347/480V modular power input socket 224. Like the 120V and 277V configurations, the 347/480V plug 216 and the 347/480V socket 224 each include at least a safety ground (green) wire 200, a power return (white) wire 202, and a power supply (black) wire 204. The safety ground (green) wire 200 and the power return (white) wire 202 of the 277V configuration are at the same pin positions as in the 120V and 277V configurations, however the power supply (black) wire 204 is at a different pin position. When used in a 347/480V dual-switched configuration, the plug 216 and socket 224 also include a second or switched power (red) wire 206.

FIGS. 10(*i*) and 10(*j*) illustrate an exemplary "UNV" or "universal" power supply configuration. The exemplary "UNV" or "universal" power supply configuration of FIG. 10 uses a UNV modular power supply plug 218 along with a UNV modular power input socket 226. A light fixture wired with the UNV power supply socket configuration can be used with either a 120V supply cord or a 277V supply cord. A light fixture wired with the 120v power supply socket configuration can be used with either a 120V supply cord or a UNV supply cord. A light fixture wired with the 277v power supply socket configuration can be used with either a 277V supply cord or a UNV supply cord.

The UNV plug 218 and the UNV socket 226 each include at least a safety ground (green) wire 200 and a power return (white) wire 202, in the same pin and socket positions as the 120V, 277V, and 347/480V configurations. However, the UNV plug 218 and the UNV socket 226 each include two power supply (black) wires 204, one power supply (black) wire 204 at each of the two pin positions used for the power supply (black) wire 204 in the 120V and 277V configurations. When used in a 120V or 277V dual-switched configuration, the plug 218 and socket 226 also include a second or switched power (red) wire 206.

Figure 11:
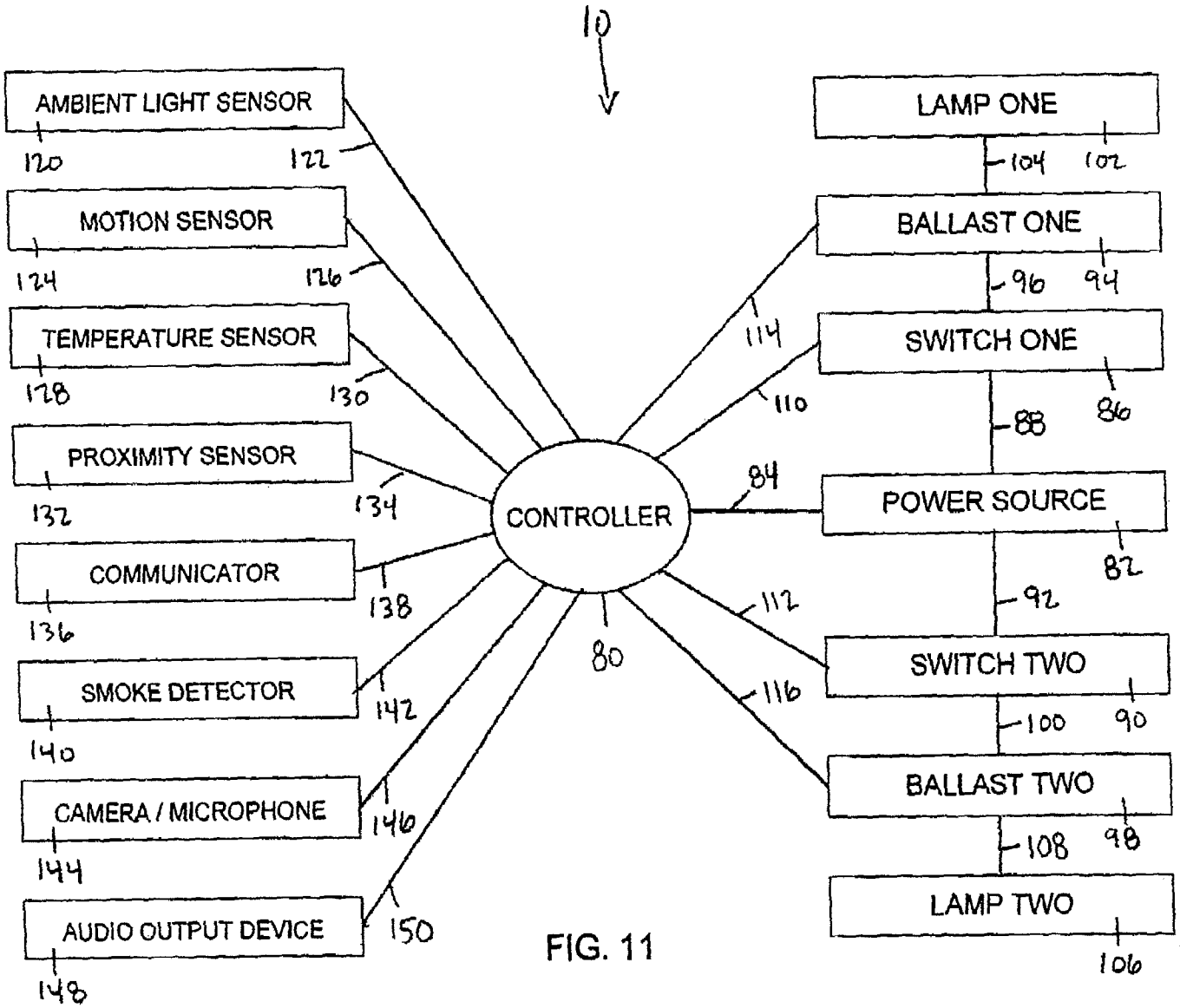
FIG. 11 is a block diagram of a controller and related components of a light fixture in accordance with an exemplary embodiment.

As shown in FIG. 11, a modular light fixture can include a controller 80, for example a microprocessor or microcontroller as known in the art. The controller 80 may include suitable non-volatile program memory, for example read-only memory (ROM) such as an electrically programmable read only memory (EPROM or EEPROM). The controller 80 may also include suitable random access memory, for storage of dynamic state variables such as environmental signals and current day/time.

The light fixture includes a power source 82, such as an electrical connector which is connected to line voltage during normal operation, and is able to deliver electrical power to the controller 80 through a controller power supply line 84.

The light fixture also includes a plurality of independently controllable lamp circuits. For example, the block diagram of FIG. 6 shows a light fixture with a first independently controllable lamp circuit that includes a first lamp 102 and a second independently controllable lamp circuit that includes a second lamp 106. However, this is not required and a single lamp circuit can be used.

Each independently controllable lamp circuit may include a ballast and an optional switch. For example, a lamp circuit for the first lamp 102 includes a first switch 86 that receives electrical power from the power source 82 on a power supply line 88. The first switch 86 delivers electrical power to a first ballast 94 on a switched power supply line 96, and the first ballast 94 provides power to the first lamp one on a ballasted power supply line 104.

The lamp circuit for the second lamp 106 may include a corresponding second switch 90 that receives electrical power from the power source 82 on a power supply line 92. The second switch 90 delivers electrical power to a second ballast 98 on a switched power supply line 100, and the second ballast 98 provides power to the second lamp 106 on a ballasted power supply line 108.

Each switch in a lamp circuit, such as the first switch 86 and the second switch 90, may be adapted to be placed into either an open condition (where the switch is an electrical open circuit through which no current flows) or in a closed condition (where the switch is an electrical closed circuit through which current can flow). To maximize efficiency, a mechanical relay switch, instead of a solid state switch, can be used so that essentially no trickle current passes through the switch when the switch is in an open condition.

The open or closed condition of each switch may be independently controllable by the controller 80. For example, the controller 80 can be connected to the first switch 86 by a switch control line 110, whereby the controller can place the first switch 86 into either a closed or an open condition. Similarly, the controller 80 can be connected to the second switch 90 by a switch control line 112, whereby the controller can place the second switch 90 into either a closed or an open condition.

Each ballast in a lamp circuit, such as the first ballast 94 and the second ballast 98, may be dimmable to allow the light output from its lamp to be adjusted by the controller 80. For example, the controller 80 can be connected to the first ballast 94 by a ballast control line 114, so that the controller can adjust the power output of the first ballast 94 to adjust the light output from the first lamp 102. Similarly, the controller 80 can be connected to the second ballast 98 by a ballast control line 116, so that the controller can adjust the power output of the second ballast 98 to adjust the light output from the second lamp 106.

The light fixture can include one or more sensors to provide information about the environment in which the light fixture operates. For example, the fixture can include an ambient light sensor 120 providing an ambient light signal to the controller 80 on an ambient light signal line 122. Using the ambient light signal, the controller 80 can adjust the light output from the fixture, for example to reduce the artificial light produced by the fixture on a sunny day when ambient light provides adequate illumination, or to increase the artificial light produced by the fixture on a cloudy day when ambient light is inadequate. The sensor can be mounted directly on the light fixture, or it can be mounted elsewhere, for example as part of the incoming power cord. For example, U.S. Pat. No. 6,746,274, the contents of which are incorporated herein by reference, teaches a motion detector built into a modular power cord.

The fixture can include a motion sensor 124 providing a motion signal to the controller 80 on a motion signal line 126. Using the motion signal, the controller 80 can turn on the fixture when the motion signal indicates the presence of motion near the fixture. Similarly, the controller 80 can turn off the fixture when the motion signal indicates the absence of any motion near the fixture.

The fixture can include a temperature sensor 128 providing a temperature signal to the controller 80 on a temperature signal line 130. The temperature signal can indicate, for example, the air temperature in the vicinity of the fixture. Alternatively, the temperature signal can indicate the temperature of the ballast or other components of the light fixture, so that any temperature rise resulting from abnormal operation or impending failure can be promptly detected to avoid ongoing inefficiency, the possibility of a fire, or a catastrophic failure of the ballast.

The fixture can include a proximity sensor 132 providing a proximity signal to the controller 80 on a proximity signal line 134. Using the proximity signal, the controller 80 can turn the fixture on or off when the proximity signal indicates the presence or absence of a person or other object near the fixture.

The fixture can also include a communicator 136 to allow communication between the controller 80 and an external system (not shown). The communicator can be, for example, of the type commonly known as X-10, or any other communicator known to those of skill in the art. For example, the communicator 136 can be connected to the controller 80 for bidirectional communication on a communicator signal line 138. With bidirectional communication, the controller 80 can receive a command from an external system, for example to dim, turn on, or turn off a lamp, and the controller 80 can acknowledge back to the external system whether or not the command has been performed successfully. Similarly, the external system could request the current temperature of the ballast of the fixture, and the controller 80 could reply with that temperature.

However, bidirectional communication is not required and one-way communication could also be used. With one-way communication, the fixture could simply receive and execute commands from an external system without providing any confirmation back to the external system as to whether the command was executed successfully or not. Similarly, the fixture could periodically and automatically transmit its status information to an external system, without requiring any request from the external system for the status information.

The fixture can include a smoke detector 140 providing a smoke detector signal to the controller 80 on a smoke detector signal line 142. Using the smoke detector signal, the controller 80 can provide a local alarm, for example with a flashing light or a siren, whenever the smoke detector signal indicates the presence of a fire or smoke. Similarly, the controller 80 can provide the smoke detector signal to an external system, for example through the communicator 136, to a security office or fire department.

The fixture can include a camera and/or microphone 144 providing a camera/microphone signal to the controller 80 on a camera/microphone signal line 146. The controller 80 can provide the camera/microphone signal to an external system, for example through the communicator 136, to a security office, time-lapse recorder, or supervisory station.

The fixture can include an audio output device 148, for example a speaker. The controller 80 can drive the audio output device 148, for example with an audio signal on an audio signal line 150, to provide an alarm, paging, music, or public address message to persons in the vicinity of the fixture. The alarm, paging, music, or public address message can be received by the controller 80 via the communicator 136 from an external system, although this is not required and the alarm, paging, music, or public address message may be internally generated.

Figure 12:
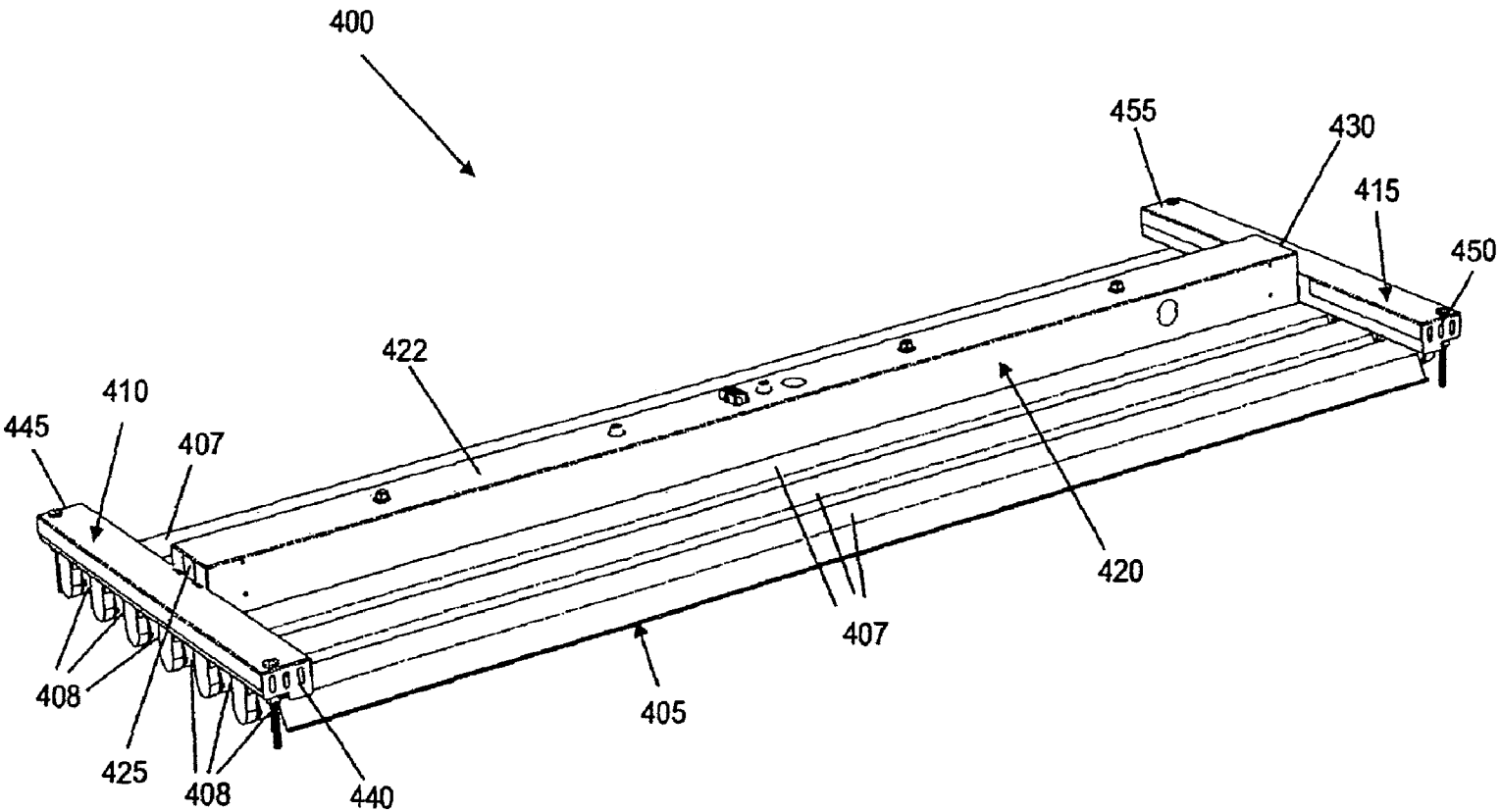
FIG. 12 is a perspective view of a modular light fixture with convective cooling in accordance with an exemplary embodiment.

In an alternative embodiment, the light fixture may not include a ballast channel for receiving the power pack. FIG. 12 is a perspective view of a light fixture 400 in accordance with a second exemplary embodiment. Light fixture 400 includes a light reflector sheet 405, a raceway 410 mounted to light reflector sheet 405, and a raceway 415 mounted to light reflector sheet 405. As illustrated with reference to FIG. 12, light reflector sheet 405 includes (six) light reflectors 407 (four of which are visible) and is adapted to accommodate six bulbs 408 which are held in place by lampholders. In alternative embodiments, light reflector sheet 405 can include any number of light reflectors 407. Further, light reflector sheet 405 can be composed of any number of light reflecting sheets. A power pack 420 is detachably mounted to the remaining components of light fixture 400. Power pack 420 includes a power pack cover 422 including a latching end 425 through which power pack 420 is mounted to raceway 410 and a latching end 430 through which power pack 420 is mounted to raceway 415. Power pack 420 can also include one or more ballasts, power input wiring, one or more power input connectors, ballast output wiring, one or more ballast output connectors, and so on such that power can be provided to bulbs 408 through the lampholders.

Figure 14:
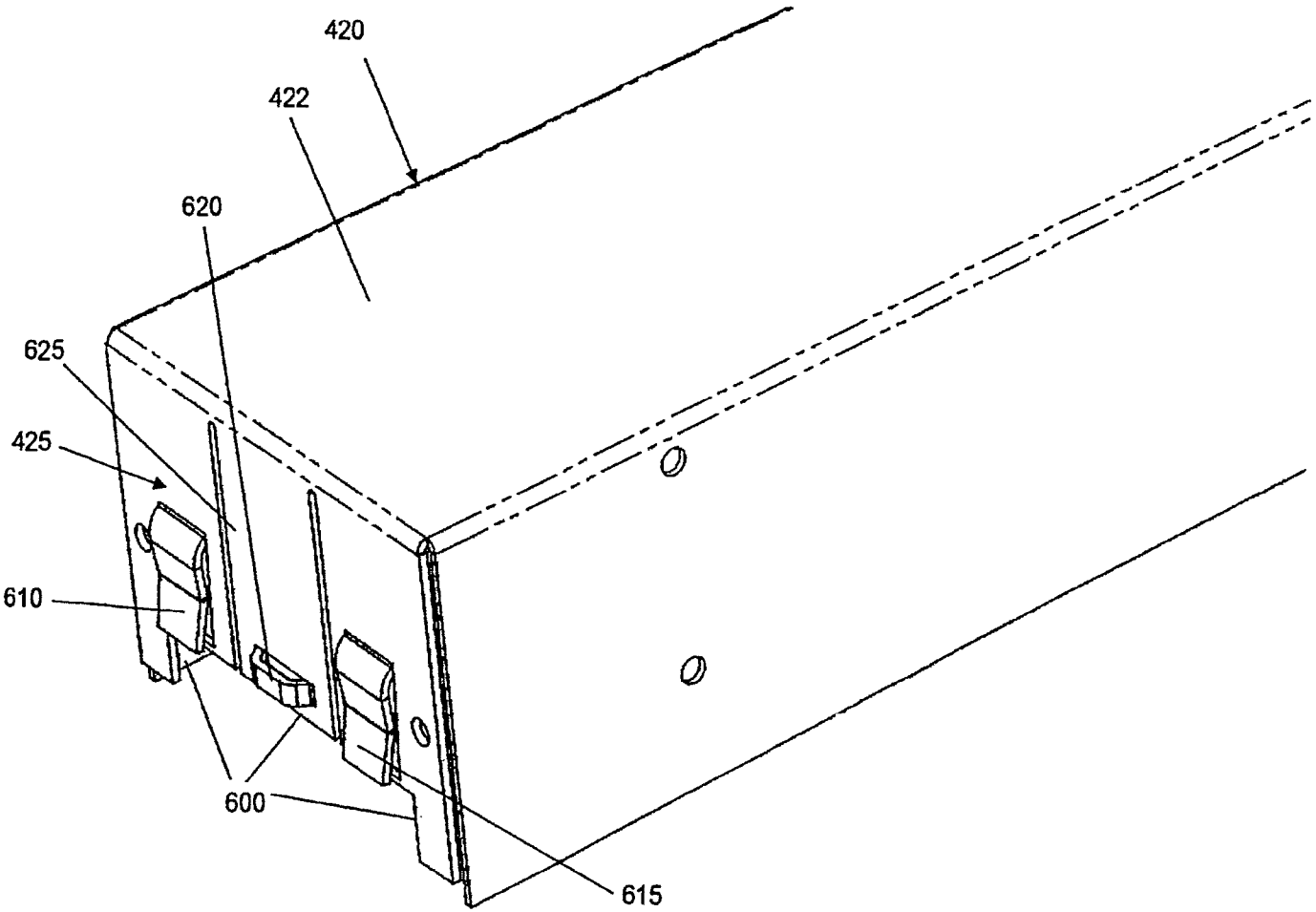
FIG. 14 is a partial view of a power pack cover illustrating a latching end opening in accordance with an exemplary embodiment.
Figure 15:
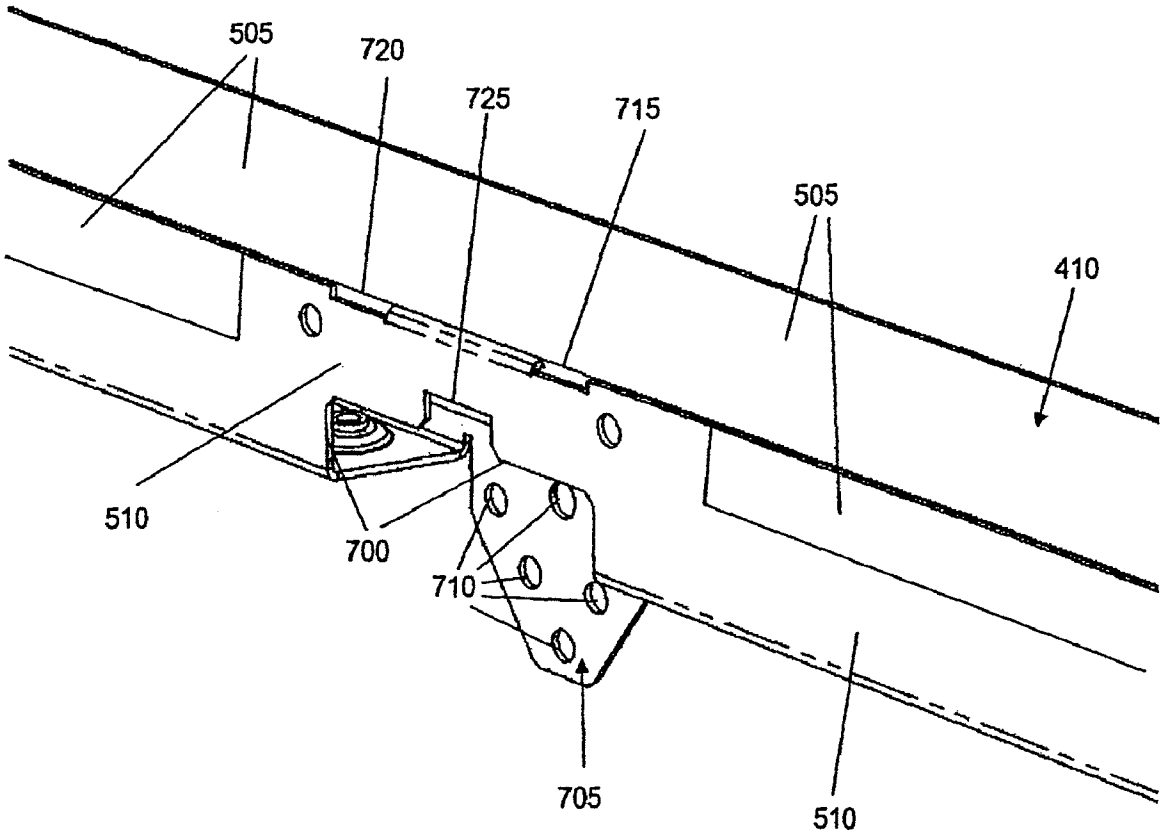
FIG. 15 is a partial view of a raceway illustrating a raceway opening in accordance with an exemplary embodiment.

FIG. 14 is a partial perspective view of latching end 425 of power pack 420 of FIG. 12 in accordance with an exemplary embodiment. FIG. 15 is a partial view of raceway 410 of FIG. 12 in accordance with an exemplary embodiment. Latching end 425 includes a first flange 610 and a second flange 615.

Raceway 410 includes a first aperture 715 adapted to receive first flange 610 and a second aperture 720 adapted to receive second flange 615. First flange 610 and second flange 615 can be used to increase the stability of power pack 420 when power pack 420 is mounted to raceway 410. First flange 610 and second flange 615 can also be used to prevent power pack 420 from contacting light reflector sheet 405 when power pack 420 is mounted to raceway 410. Raceway 410 also includes a locking aperture 725 adapted to receive a locking protrusion 620 on latching end 425 of power pack cover 422. Locking protrusion 620 is mounted to a flexible tab 625. In an exemplary embodiment, power pack 420 can be attached and removed without the use of tools.

As illustrated with reference to FIGS. 13 and 15, raceway 410 can include a raceway base 510 and a raceway cover 505. Raceway cover 505 is mounted to raceway base 510 with fasteners 515 to form a raceway cavity. As illustrated with reference to FIG. 15, first aperture 715 and second aperture 720 are formed along the boundary of raceway base 510 and raceway cover 505. In an exemplary embodiment, raceway base 510 can include a bottom surface and one or more side walls mounted to the bottom surface. The bottom surface can include apertures adapted to receive lampholders. Raceway cover 505 can include a top surface and one or more side walls mounted to the top surface. When mounted, the one or more side walls of raceway cover 505 may at least partially overlap the one or more side walls of raceway base 510 (or vice versa). In alternative embodiments, the raceway may be a one piece unit and/or the apertures may be formed along any portion of the raceway.

In an exemplary embodiment, power pack 420 can be detachably mounted to raceway 410 by causing first flange 610 and second flange 615 to mate with first aperture 715 and second aperture 720 respectively, and by causing locking protrusion 620 to mate with locking aperture 725. Locking protrusion 620 can be made to mate with locking aperture 725 by depressing flexible tab 625 such that locking protrusion 620 is able to slide along (or past) an outer surface of raceway base 510. Releasing flexible tab 625 can cause locking protrusion 620 to mate with locking aperture 725. Similarly, power pack 420 can be detached from raceway 410 by depressing flexible tab 625 such that locking protrusion 620 is disengaged from locking aperture 725. Once locking protrusion 620 is disengaged, power pack 420 can be slid upward such that first flange 610 and second flange 615 disengage from first aperture 715 and second aperture 720.

Figure 13:
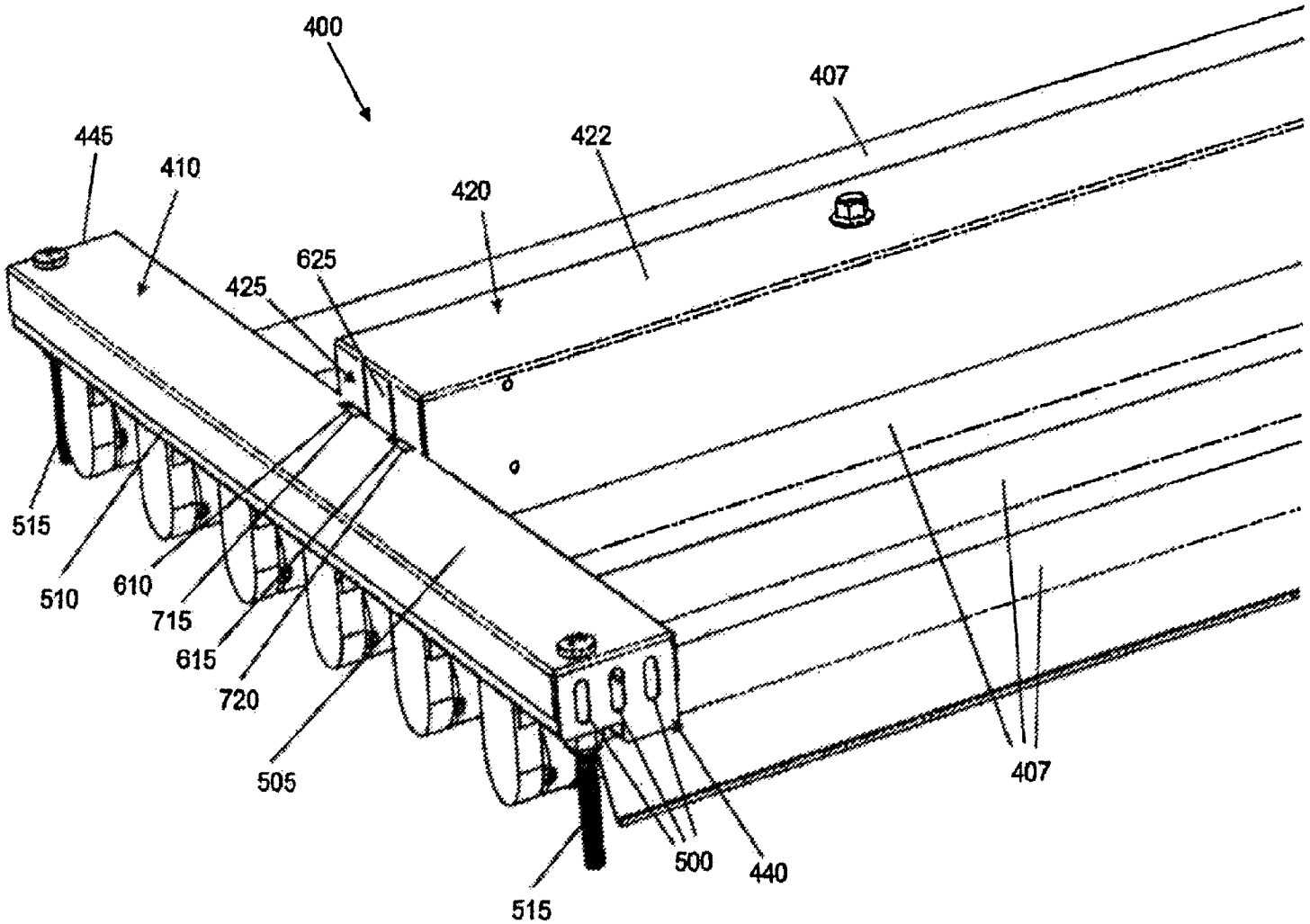
FIG. 13 is a partial view of the modular light fixture of FIG. 12 illustrating a convective endplate in accordance with an exemplary embodiment.

FIG. 13 is a partial view of light fixture 400 of FIG. 12 illustrating latching end 425 mounted to raceway 410 in accordance with an exemplary embodiment. First flange 610 is inserted into first aperture 715 and second flange 615 is inserted into second aperture 720. Further, locking protrusion 620 (not visible) is locked in place within locking aperture 725 (not visible). Power pack 420 can be removed by depressing flexible tab 625 and sliding (or lifting) power pack 420 away from light fixture 400. In an exemplary embodiment, latching end 430 illustrated with reference to FIG. 12 can function in the same manner as latching end 425. As such, power pack 420 can be removed from light fixture 400 by, either substantially simultaneously or successively, causing latching end 425 and latching end 430 to disengage from raceway 410 and raceway 415, respectively. In an alternative embodiment, latching end 430 may be different from latching end 425. For example, latching end 430 may include only a single protrusion adapted to mate with an aperture in raceway 415. In alternative embodiments, latching end 425 and/or latching end 430 may include any other number of protrusions and/or flanges adapted to mate with counterpart apertures in raceway 410 and raceway 415. In another alternative embodiment, the locations of the apertures and protrusions may be reversed. For example, the latching ends may include the apertures and/or the locking aperture, and the raceways may include the flanges and/or the locking protrusion.

As known to those of skill in the art, ballasts used to supply power to light bulbs may produce a substantial amount of heat. FIG. 12 illustrates convective cooling apertures to help disperse the heat in accordance with an exemplary embodiment. Raceway 410 includes a convective endplate 440 and a convective endplate 445. Similarly, raceway 415 includes a convective endplate 450 and a convective endplate 455. The convective endplates are described in more detail with reference to FIG. 13. Power pack 420 is detachably mounted on an upper surface of light reflecting sheet 405 between raceway 410 and raceway 415. In an exemplary embodiment, power pack 420 can rest on or adjacent to the upper surface of light reflecting sheet 405, and a ballast cover channel may not be used.

FIG. 13 is a partial view of light fixture 400 illustrating convective endplate 440 in accordance with an exemplary embodiment. Convective endplate 440 includes a plurality of apertures 500 adapted to dissipate heat generated by the one or more ballasts mounted to power pack cover 422. Apertures 500 can be any shape and/or size sufficient to provide convective cooling. Convective endplate 445 can also include a plurality of apertures (not visible). While three apertures are illustrated, it is to be understood that any number of apertures may be provided in convective endplate 440 and convective endplate 445. Convective endplate 440 can be mounted to raceway cover 505 or raceway base 510 depending on the embodiment. In alternative embodiments, apertures 500 can be included in raceway cover 505 and/or raceway base 510 to provide convective cooling.

In an exemplary embodiment, apertures 500 can be used to disperse heat generated by the ballast(s). FIG. 14 is a partial view of power pack cover 422 illustrating a latching end opening 600 in accordance with an exemplary embodiment. FIG. 15 is a partial view of raceway 410 illustrating a raceway opening 700 in accordance with an exemplary embodiment. In an exemplary embodiment, power pack 420 can be mounted such that latching end opening 600 is substantially aligned with raceway opening 700. As such, air is able to circulate throughout light fixture 400 and heat from the ballast can be dispersed. Heat can travel from a ballast mounted to power pack cover 422 in either direction along the length of power pack cover 422. At latching end 430, the heat can pass through latching end opening 600, through raceway opening 700, and into a cavity of raceway 410. Air flowing into apertures 500 of convective endplate 440 and out of the apertures of convective endplate 445 (or vice versa) can cause the heat in the cavity of raceway 410 to be dispersed. Raceway 415 can be likewise configured such that heat can also be dispersed through convective endplate 450 and convective endplate 455 illustrated with reference to FIG. 12. In alternative embodiments, the heat can be dispersed through apertures in raceway cover 505 and/or raceway base 510.

Figure 16:
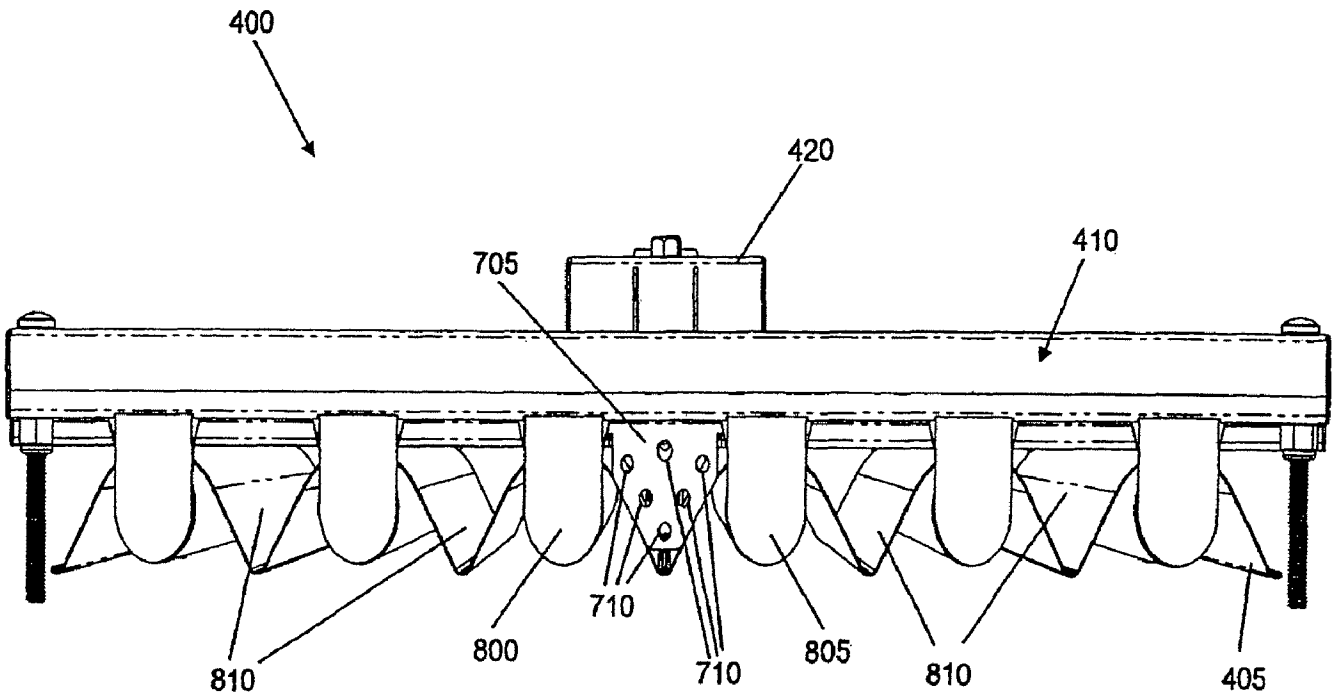
FIG. 16 is an end view of the modular light fixture of FIG. 12 illustrating a convective cover plate in accordance with an exemplary embodiment.

FIG. 15 illustrates a convective cover plate 705 mounted to raceway 410 in accordance with an exemplary embodiment. Convective cover plate 705 includes a plurality of apertures 710 adapted to dissipate heat generated by the ballast(s). FIG. 16 is an end view of light fixture 400 illustrating convective cover plate 705 in accordance with an exemplary embodiment. In an exemplary embodiment, convective cover plate 705 is mounted to raceway 410 as illustrated with reference to FIG. 15. Alternatively, convective cover plate 705 can be mounted to light reflecting sheet 405. Convective cover plate 705 may be positioned between a lampholder 800 and a lampholder 805 such that the ballast, wiring, connectors, and any other elements within power pack 420 are not readily visible. In an exemplary embodiment, any number of apertures 710 can be used, and apertures 710 can be any size and shape sufficient to provide convective cooling.

In an exemplary embodiment, an upper surface of light reflecting sheet 405 can form a plurality of valleys 810. Convective cover plate 705 can be mounted at a first end of the valley over which power pack 420 is mounted. Similarly, a second convective cover plate (not shown) can be mounted at the other end of the valley over which power pack 420 is mounted. As such, air can readily circulate through the valley, and heat generated by the ballast can be dispersed. Additionally, light fixture 400 can remain aesthetically pleasing. Convective cover plate(s) can be used alone or in combination with the above-described convective endplate(s), depending on the embodiment.

Figure 17:
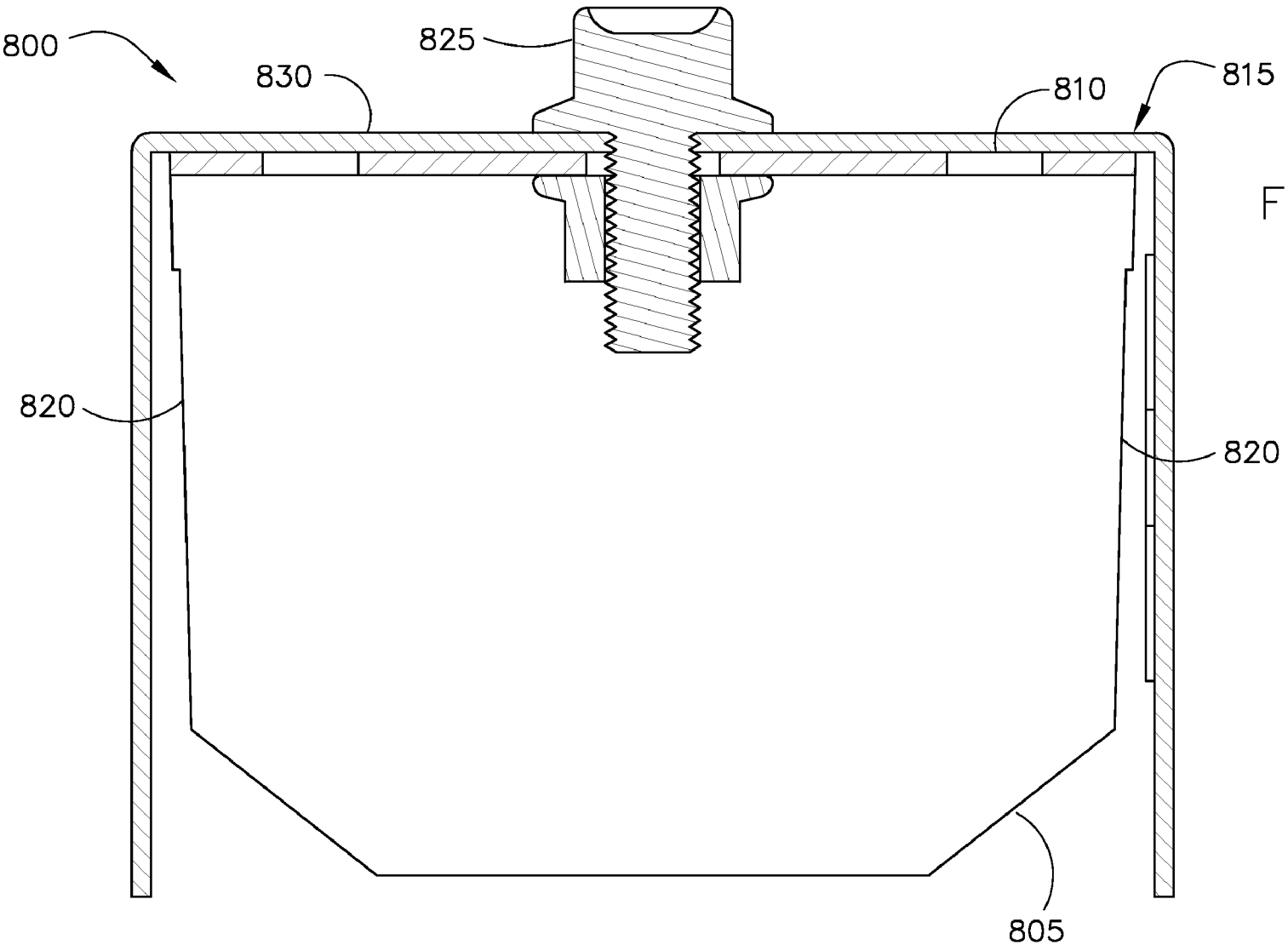
FIG. 17 is a cross-sectional view of a ballast mounted to a power pack such that radiative cooling occurs in accordance with an exemplary embodiment.

FIG. 17 is a cross-sectional view of a ballast 805 mounted to a power pack 800 such that convective and radiative cooling occurs in accordance with an exemplary embodiment. Ballast 805 is mounted such that a base 810 of ballast 805 is in direct contact with an inner surface of a power pack cover 815. Ballast 805 can be mounted such that sides 820 of ballast 805 are also in direct contact with the inner surface of power pack cover 815. Alternatively, sides 820 of ballast 805 may be mounted such that they are in contact with a heat conducting material mounted to the inner surface of power pack cover 815. Alternatively, sides 820 of ballast 805 may be mounted such that there is an air gap between sides 820 and the inner surface of power pack cover 815. A fastener 825 can be used to secure ballast 805 to power pack cover 815. In an exemplary embodiment, fastener 825 can be a bolt. Alternatively, any other type of fastener and/or mounting method can be used to mount ballast 805 to power pack cover 815.

In an exemplary embodiment, power pack cover 815 can be made of aluminum. Alternatively, power pack cover 815 can be made of any other material which is capable of effectively conducting heat. As a result, heat generated by ballast 805 can conduct through ballast 805, conduct through power pack cover 815, and radiate into a surrounding environment. Heat can also be dispersed into the surrounding environment through direct contact of ballast 805 and fastener 825. In one embodiment, paint and/or other coverings on the outer surface of ballast 805 can be removed such that heat is more effectively radiated through power pack cover 815.

In another exemplary embodiment, an emissive coating can be applied to an outer surface 830 of power pack cover 815 and/or fastener 825. As known to those of skill in the art, the surface emissivity of uncoated, commercially available aluminum and other metals can be extremely low. The emissive coating can be applied to outer surface 830 such that the surface emissivity of power pack cover 815 is increased. As a result, power pack cover 815 is able to emit more heat by radiation into the surrounding environment. The emissive coating can be a paint, a film, a tape, a powder coating, or any other material which is configured to provide a higher emissivity to power pack cover 815. Alternatively, the emissive coating can be obtained by anodizing or otherwise altering outer surface 830. In an exemplary embodiment, the emissive coating can be a black powder coating. Alternatively, the emissive coating can be a black or other highly emissive paint. Alternatively, the emissive coating can be any other color and/or material which is capable of raising the emissivity of power pack cover 815.

Figure 18:
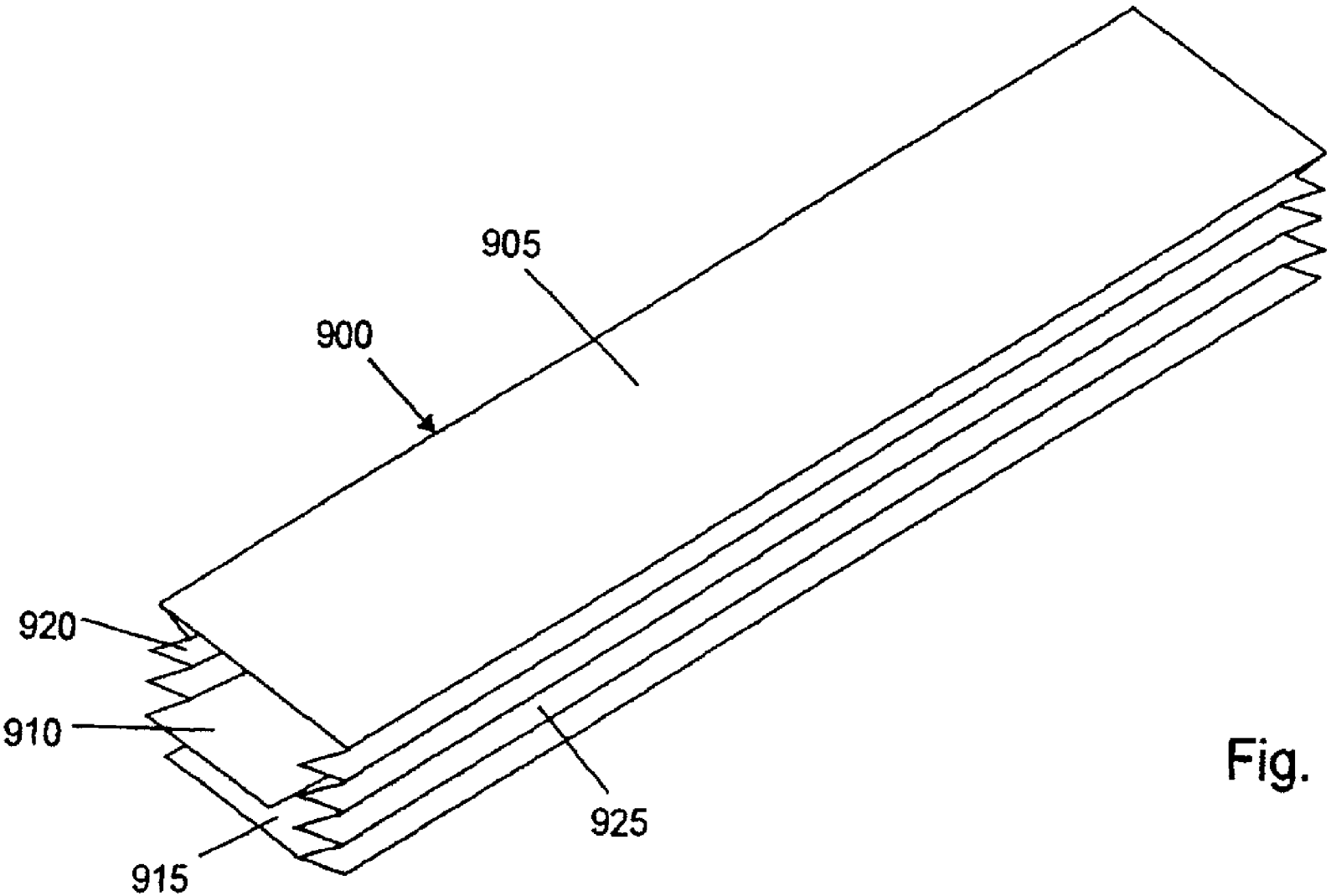
FIG. 18 is a perspective view of a collapsible radiator in accordance with an exemplary embodiment.

In an exemplary embodiment, heat can also be removed from the ballast by mounting a radiator to the power pack cover. FIG. 18 is a perspective view of a collapsible radiator 900 in accordance with an exemplary embodiment. Collapsible radiator 900 includes a top surface 905, a first bottom surface 910, a second bottom surface 915, a first collapsible side surface 920, and a second collapsible side surface 925. In an exemplary embodiment, first collapsible side surface 920 and second collapsible side surface 925 can be made of a flexible material and formed into an accordion pattern such that collapsible radiator 900 can expand and collapse, thereby raising and lowering top surface 905. Collapsible radiator 900 can be mounted to a power pack cover such that first bottom surface 910 and second bottom surface 915 are secured between the ballast and the power pack cover. As described in more detail with reference to FIGS. 19 and 20, the power pack cover can include side slots or top slots adapted to receive first bottom surface 910 and second bottom surface 915. In an exemplary embodiment, collapsible radiator 900 can be approximately the same length as the ballast over which collapsible radiator 900 is mounted, and a single collapsible radiator can be mounted above each ballast in the power pack. In another exemplary embodiment, collapsible radiator 900 can be held in between the ballast and the power pack cover by friction. Alternatively, collapsible radiator 900 can be any other length. In another alternative embodiment, collapsible radiator 900 may be held in place by fasteners or by any other method known to those of skill in the art.

In an exemplary embodiment, collapsible radiator 900 can be composed of copper or any other material which is able to conduct heat better than the power pack cover to which collapsible radiator 900 is mounted. As such, heat can be conducted from the ballast to first bottom surface 910 and second bottom surface 915 of collapsible radiator 900. From first bottom surface 910 and second bottom surface 915, the heat can be conducted to first collapsible side surface 920 and second collapsible side surface 925, and to top surface 905. In another exemplary embodiment, first collapsible side surface 920, second collapsible side surface 925, and top surface 905 of collapsible radiator 900 can be composed of a highly emissive material or have an emissive coating such that radiation of heat away from the light fixture is maximized. The heat can also be removed from the light fixture through convection by air which passes by collapsible radiator 900 and through a cavity of collapsible radiator 900.

Figure 19A:
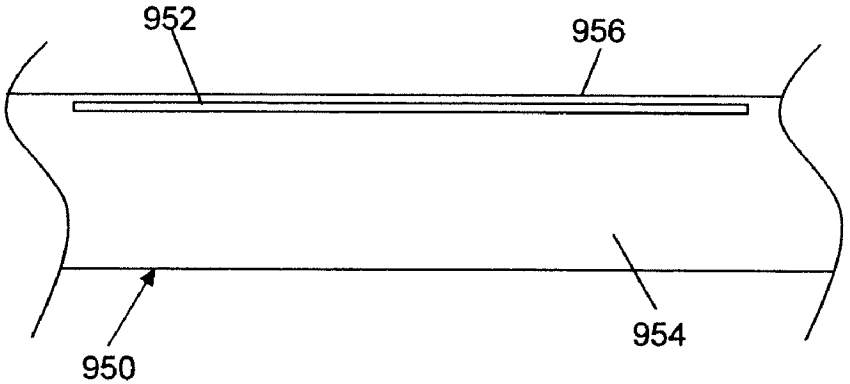
FIG. 19A is a partial side view of a power pack cover including a first side slot in accordance with an exemplary embodiment.

FIG. 19A is a partial side view of a power pack cover 950 including a first side slot 952 in accordance with an exemplary embodiment. First side slot 952 is positioned in a first side 954 of power pack cover 950, adjacent to a top 956 of power pack cover 950. A second side slot (not visible) can be positioned directly opposite first side slot 952 in a second side (not visible) of power pack cover 950. In an exemplary embodiment, first bottom surface 910 of collapsible radiator 900 can be placed through first side slot 952 and second bottom surface 915 can be placed through the second side slot. A ballast can be securely mounted to power pack cover 950 such that collapsible radiator 900 is mounted to power pack cover 950 with first bottom surface 910 and second bottom surface 915 in between the ballast and top 956 of power pack cover 950.

Figure 19B:
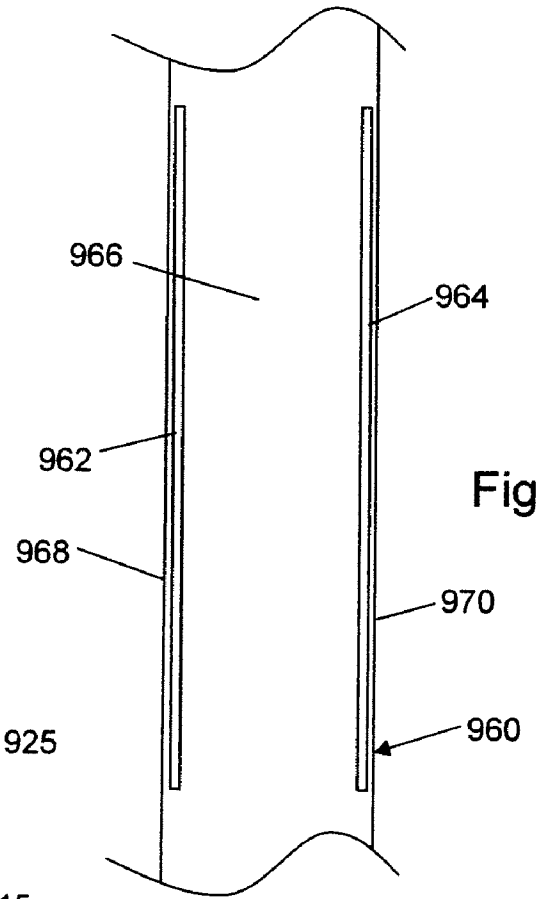
FIG. 19B is a partial top view of a power pack cover including a first top slot and a second top slot in accordance with an exemplary embodiment.
Figure 19C:
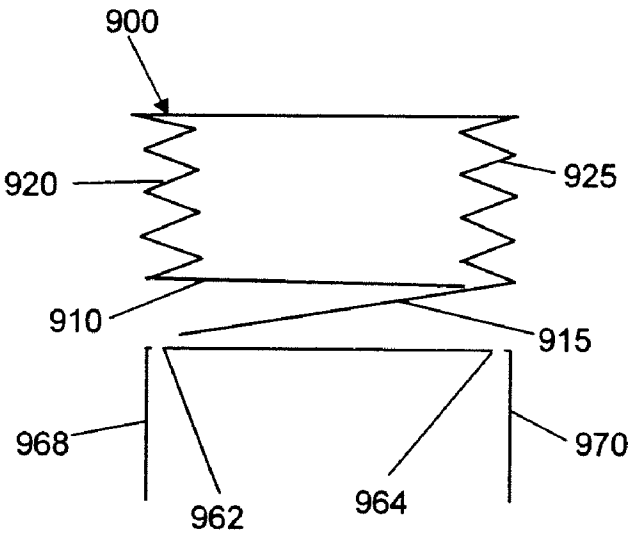
FIG. 19C is a cross-sectional view of a collapsible radiator and a power pack cover in accordance with an exemplary embodiment.

FIG. 19B is a partial top view of a power pack cover 960 including a first top slot 962 and a second top slot 964 in accordance with an exemplary embodiment. First top slot 962 and second top slot 964 are positioned in a top 966 of power pack cover 960 with first top slot 962 adjacent to a first side 968 of power pack cover 960 and second top slot 964 adjacent to a second side 970 of power pack cover 960. FIG. 19C is a cross-sectional view of collapsible radiator 900 and power pack cover 960 in accordance with an exemplary embodiment. In an exemplary embodiment, first bottom surface 910 of collapsible radiator 900 can be placed through first top slot 962 and second bottom surface 915 can be placed through second top slot 964. A ballast (not shown) can be securely mounted to power pack cover 960 such that collapsible radiator 900 is mounted to power pack cover 960 with first bottom surface 910 and second bottom surface 915 in between the ballast and top 966 of power pack cover 960.

Figure 20B:
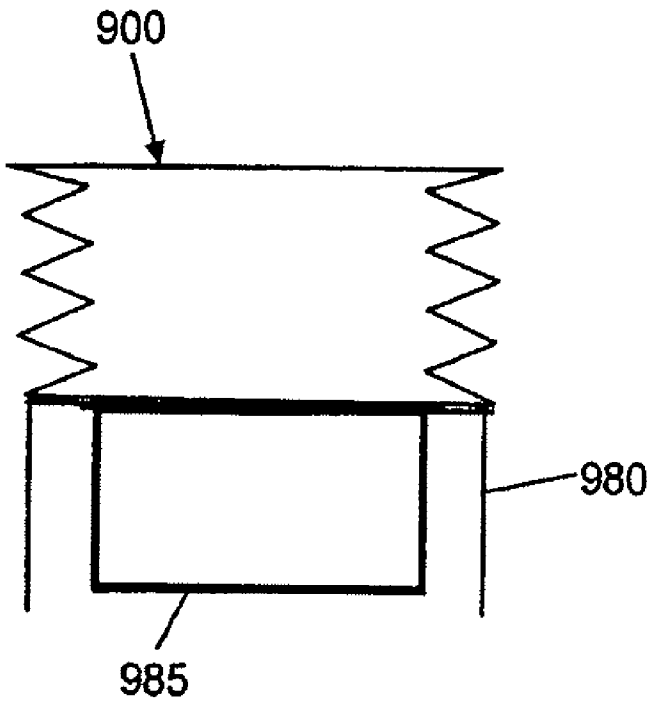
FIG. 20B is a cross-sectional view illustrating a collapsible radiator in a partially expanded state and mounted to a power pack cover in accordance with an exemplary embodiment.
Figure 20A:
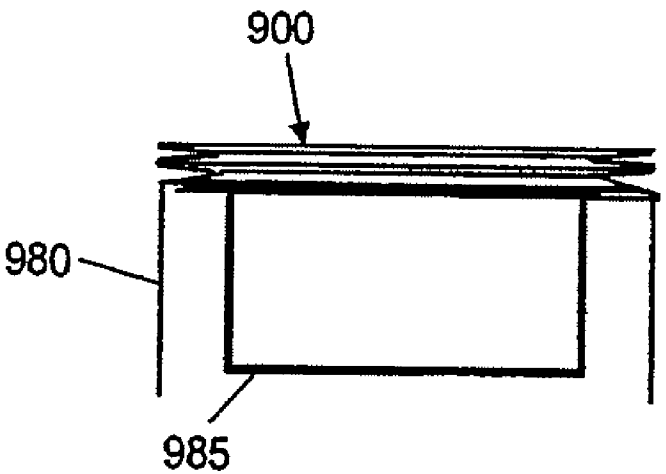
FIG. 20A is a cross-sectional view illustrating a collapsible radiator in a collapsed state and mounted to a power pack cover in accordance with an exemplary embodiment.

FIG. 20A is a cross-sectional view illustrating collapsible radiator 900 in a collapsed state and mounted to a power pack cover 980 in accordance with an exemplary embodiment. FIG. 20B is a cross-sectional view illustrating collapsible radiator 900 in a partially expanded state and mounted to power pack cover 980 in accordance with an exemplary embodiment. As described above, first bottom surface 910 and second bottom surface 915 of collapsible radiator 900 are mounted between a ballast 985 and power pack cover 980. As such, heat generated by ballast 985 can be conducted to collapsible radiator 900 and radiated and/or removed by convection into a surrounding environment. In an exemplary embodiment, collapsible radiator 900 can be left in the collapsed state during manufacturing and shipping such that shipping costs of the light fixture are not increased. Upon installation, collapsible radiator 900 can be expanded to provide a greater surface area through which heat from ballast 985 can be removed.

Figure 21A:
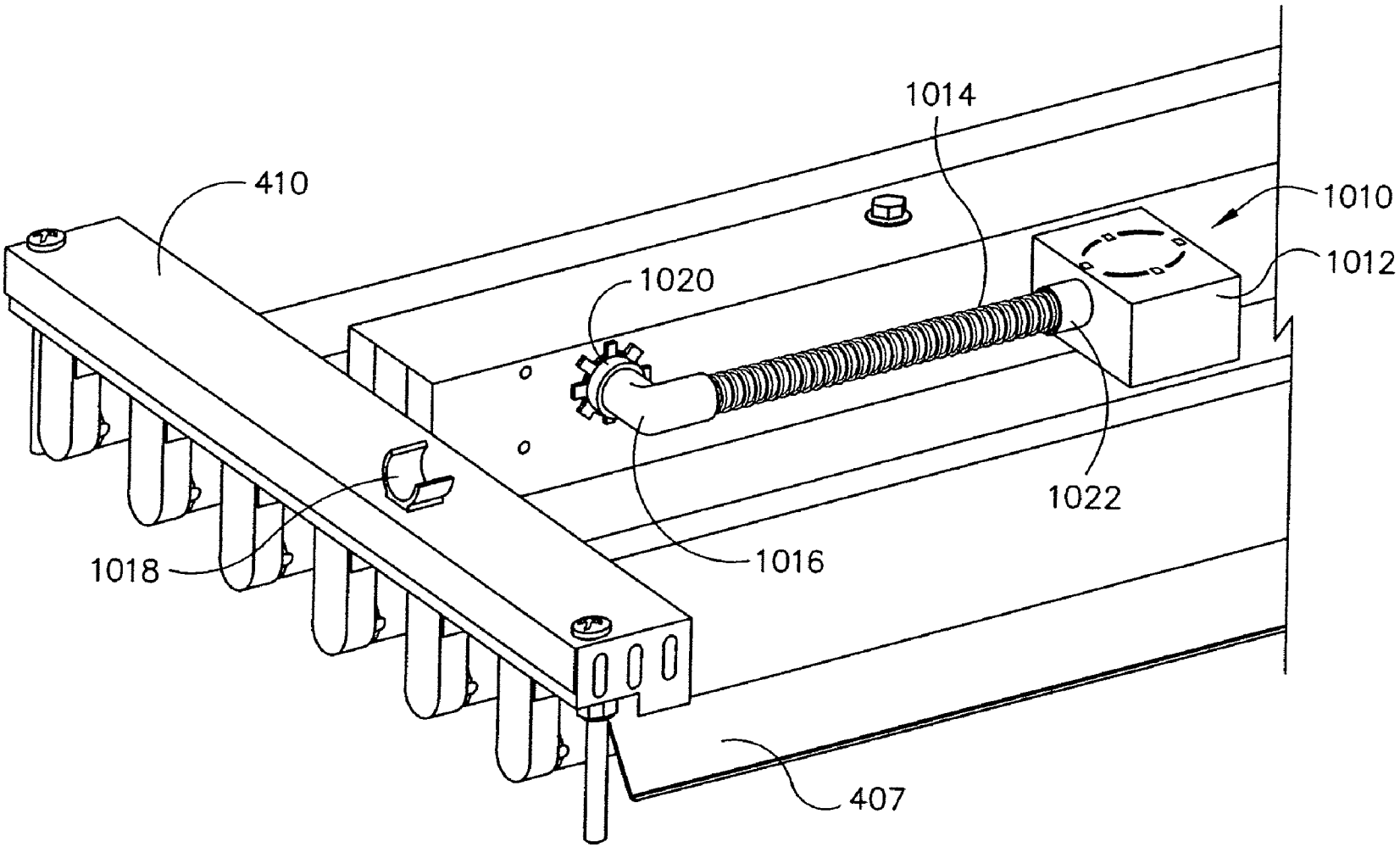
FIG. 21A is a partial view of a modular light fixture illustrating a deployable sensor (shown in a stowed position) mounted to a power pack in accordance with an exemplary embodiment.
Figure 21B:
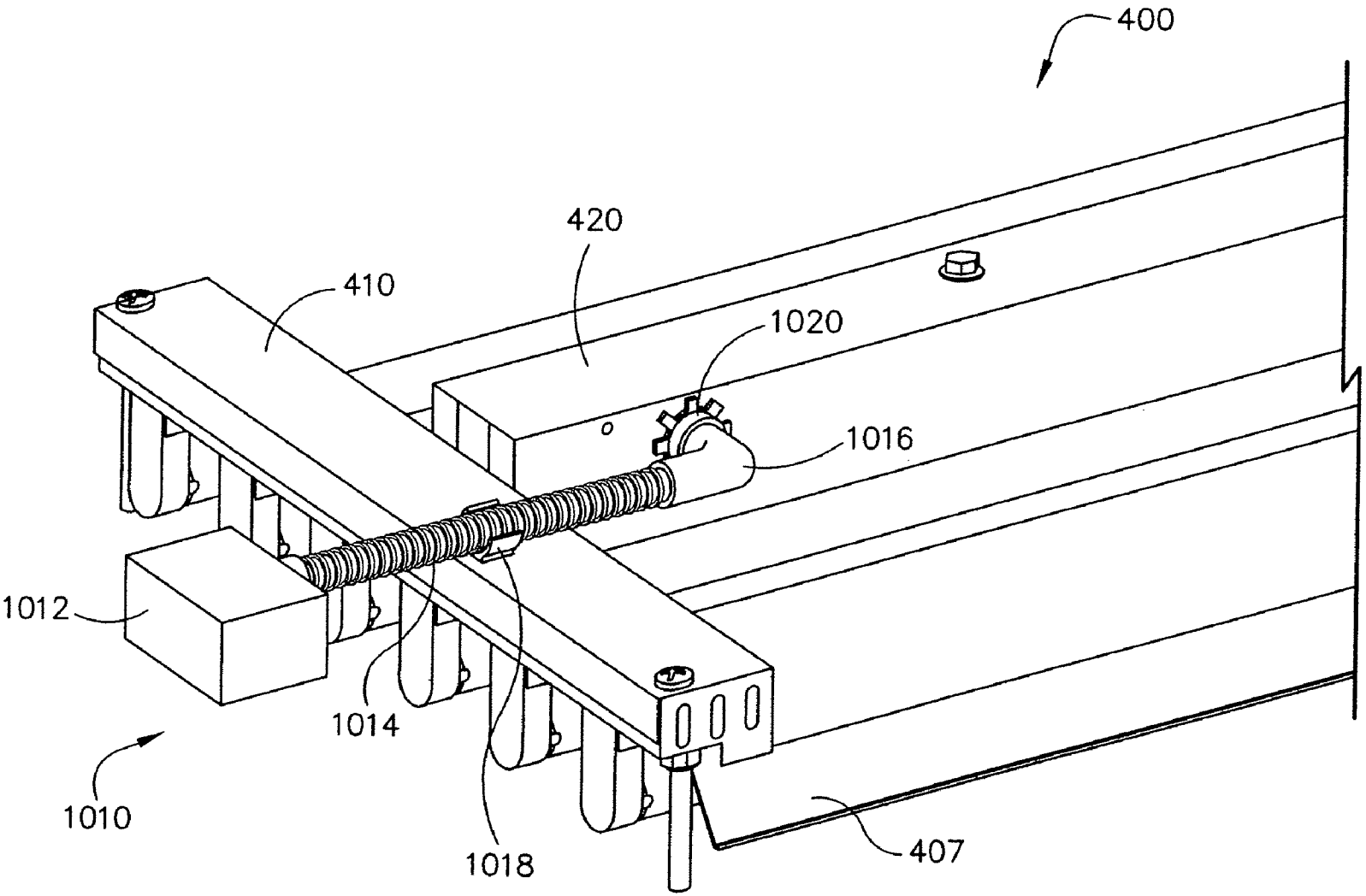
FIG. 21B is a partial view of a modular light fixture illustrating a deployable sensor (shown in a deployed position) mounted to a power pack in accordance with an exemplary embodiment.

Referring to FIGS. 21A and 21B, a deployable sensor for use with a power pack on a light fixture is shown according to an exemplary embodiment. The deployable sensor 1010 may be operable to monitor any of a wide variety of parameters and provide an output signal for control of the fixture 400. According to one embodiment, the deployable sensor 1010 is operable to monitor an ambient light level, and/or the presence of occupants in an area proximate the fixture 400, using a motion detecting technology such as infrared.

The deployable sensor 1010 is shown mounted on power pack 420 of fixture 400, and includes a sensor head 1012, a conduit 1014 (e.g. a flexible conduit such as a tube, hose, etc.), a fitting 1016 (shown for example as a 900 elbow fitting), a bracket 1018 (e.g. clip, holder, etc.) and a pivotable coupling 1020 (e.g. swivel seal, grommet, etc.) for mounting the sensor head 1012, conduit 1014, and fitting 1016 to the power pack 420. Bracket 1018 is shown mounted on a surface of raceway 410 and in a location adapted to receive and hold conduit 1014 so that sensor head 1012 is disposed in a desired location relative to the fixture 400. For example, bracket 1018 is shown located on raceway 410 in general axial alignment with a longitudinal side of power pack 420, so that conduit 1014 extends generally parallel to power pack 410 and perpendicular to raceway 410. According to alternative embodiments, conduit may be shaped or routed in any desirable pattern for positioning the sensor head in any desired position or location relative to the fixture.

The sensor head 1012 includes a sensor "eye" that may be installed in the sensor head prior to shipping, or upon receipt of the fixture 400 at an installation location. The sensor head 1012 also includes suitable wiring that is routed through the conduit 1014, fitting 1016 and pivotable coupling 1020 and is connected to wiring in the power pack 420 in a suitable manner. The sensor head 1012 may also include a suitable fitting or connector 1022 for securing to the sensor head 1012 and to an end of the conduit 1014 that is opposite the pivotable coupling 1020 (e.g. by a threaded connection, friction fit, snap connect, or any other suitable connection).

Pivotable coupling 1020 is operable to permit rotational movement of fitting 1016 and conduit 1014 through a path of at least approximately 180° so that the assembly of the fitting 1016, conduit 1014 and sensor head 1012 are rotatable between a stowed position (shown in FIG. 21A) and a deployed position (shown in FIG. 21B). According to the illustrated embodiment, in the stowed position, the sensor head 1012, conduit 1014 and fitting 1016 are aligned generally parallel to power pack 420 and to light reflectors 407, in order to provide a relatively secure shipping and installation position where the components do not extend from the structure of the fixture 400 and are less likely to be damaged due to unintentional impact with other objects. Another bracket (not shown) may be mounted on a side surface of the power pack or on a top surface of a light reflector and designed to receive and hold the conduit during shipping and installation activities to further provide for a more secure retention of the components.

When desired for placing fixture 400 in service with sensing capability, sensor head 1012 may be moved to the deployed position (see FIG. 21B) by rotating the fitting 1016, conduit 1014 and sensor head 1012 approximately 180° from the stowed position, and then securing the conduit 1014 to the bracket 1018 (e.g. by friction fit, interference fit, snap-connect, etc.). In a similar but opposite manner, the sensor head 1012 may be moved to the stowed position in preparation for shipping, installation or other activities that may risk damage to the sensor head, or in the event that operation of the fixture without sensing capability is desired. Installation (and/or) replacement of the sensor head 1012 may be accomplished by simply removing and replacing the power pack 420 and deployable sensor 1010 as single integral unit.

Figure 22:
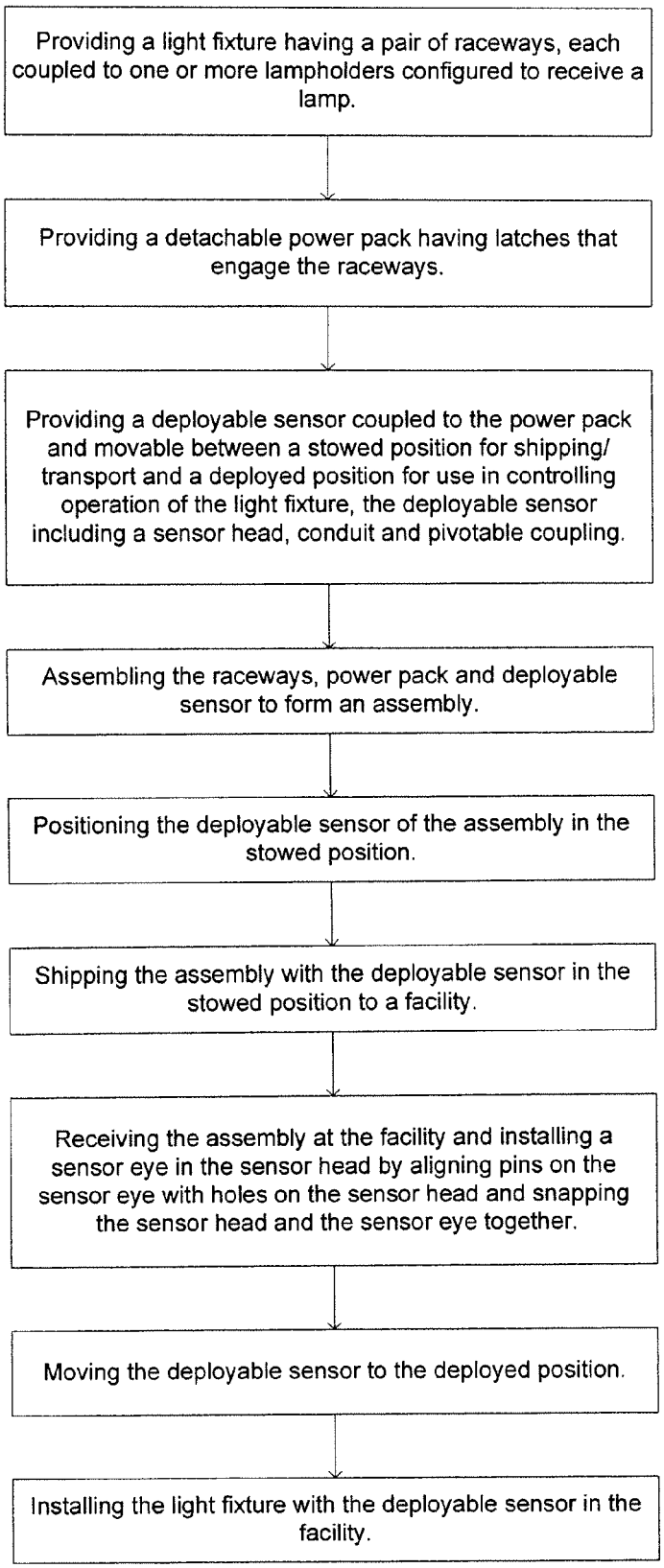
FIG. 22 is a block diagram of a method of providing a light fixture with a deployable sensor according to an exemplary embodiment.

Referring to FIG. 22, a method of providing a light fixture with a deployable sensor is shown to include the following steps, according to an exemplary embodiment. Providing a light fixture having a pair of raceways, each coupled to one or more lampholders configured to receive a lamp. Providing a detachable power pack having latches that engage the raceways. Providing a deployable sensor coupled to the power pack and movable between a stowed position for shipping/transport and a deployed position for use in controlling operation of the light fixture, the deployable sensor including a sensor head, conduit and pivotable coupling. Assembling the raceways, power pack and deployable sensor to form an assembly. Positioning the deployable sensor in the stowed position. Shipping the assembly with the deployable sensor in the stowed position to a facility. Receiving the assembly at the facility and installing a sensor eye in the sensor head by aligning pins one the sensor eye with holes on the sensor head and snapping the sensor head and the sensor eye together. Moving the deployable sensor to the deployed position. Installing the light fixture with the deployable sensor in the facility. Replacing the deployable sensor by removing the integral assembly of the power pack and the deployable sensor with a replacement integral assembly (i.e. a new power pack and deployable sensor coupled together as an integral unit).

It is to be understood that the details of construction and the arrangement of components set forth in the description and illustrated in the drawings are not meant to be limiting. The invention is capable of other embodiments and of being practiced or of being carried out in various ways. Also, it is to be understood that the phraseology and terminology used herein is for the purpose of description and should not be regarded as limiting.

It is important to note that the construction and arrangement of the elements of the light fixture and other structures shown in the exemplary embodiments and discussed herein are illustrative only. Those skilled in the art who review this disclosure will readily appreciate that many modifications are possible (e.g., variations in sizes, dimensions, structures, shapes and proportions of the various elements, values of parameters, mounting arrangements, materials, transparency, color, orientation, etc.)

The particular materials used to construct the exemplary embodiments are also illustrative. For example, although the reflectors in the exemplary embodiment are made of aluminum, other materials having suitable properties could be used. All such modifications, to materials or otherwise, are intended to be included within the scope of the present invention as defined in the appended claims.

The order or sequence of any process or method steps may be varied or re-sequenced according to alternative embodiments. Other substitutions, modifications, changes and/or omissions may be made in the design, operating conditions and arrangement of the exemplary embodiments without departing from the spirit of the present invention as expressed in the appended claims.

The components of the invention may be mounted to each other in a variety of ways as known to those skilled in the art. As used in this disclosure and in the claims, the terms mount and attach include embed, glue, join, unite, connect, associate, hang, hold, affix, fasten, bind, paste, secure, bolt, screw, rivet, solder, weld, and other like terms. The term cover includes envelop, overlay, and other like terms. It is understood that the invention is not confined to the embodiments set forth herein as illustrative, but embraces all such forms thereof that come within the scope of the following claims.

What is claimed is:

1. A light fixture comprising:

a raceway comprising an aperture and a locking aperture;

a lampholder electrically connected to a lampholder connector; and a power pack comprising a power pack cover including a latching end, wherein the latching end comprises a flange and a locking protrusion, and further wherein the flange is adapted to mate with the aperture of the raceway and the locking protrusion is adapted to mate with the locking aperture of the raceway such that the power pack is detachably mountable to the raceway;

a ballast mounted to the power pack cover, wherein the ballast includes a power input connector adapted to electrically connect to a power cord and a ballast output connector adapted to electrically connect to the lampholder connector; and a deployable sensor movable between a stowed position and a deployed position.

2. The light fixture of claim 1, wherein the deployable sensor comprises a conduit, a sensor head coupled to one end of the conduit, and a pivotable coupling coupled to another end of the conduit and to the power pack to provide a power pack and deployable sensor as a single integrated unit.

3. The light fixture of claim 2, further comprising a bracket mounted on the raceway and operable to receive and retain the conduit when the deployable sensor is in the deployed position.

4. The light fixture of claim 3, wherein the conduit and sensor head are aligned substantially parallel with the power pack and when the conduit and sensor head are in the stowed position.

5. The light fixture of claim 4, wherein the deployed position and the stowed position are substantially axially aligned and 180° apart.

6. The light fixture of claim 1, further comprising:

a second raceway comprising a second aperture and a second locking aperture; and further wherein the power pack cover further includes a second latching end comprising a second flange and a second locking protrusion, wherein the second flange is adapted to mate with the second aperture of the second raceway and the second locking protrusion is adapted to mate with the second locking aperture of the second raceway such that the power pack is detachably mountable to the second raceway.

7. The light fixture of claim 1, wherein the raceway comprises a raceway base and a raceway cover mounted to the raceway base.

8. The light fixture of claim 7, wherein the aperture is formed along a boundary between the raceway base and the raceway cover.

9. The light fixture of claim 7, wherein the locking aperture is formed in the raceway base.

10. A method of providing a light fixture with a deployable sensor, comprising:

providing a light fixture having a pair of raceways, each coupled to one or more lampholders configured to receive a lamp;

providing a power pack engagable with the raceways providing a deployable sensor coupled to the power pack and movable between a stowed position and a deployed position, the deployable sensor including a sensor head, conduit and pivotable coupling;

assembling the power pack and the deployable sensor to form an integral assembly;

assembling the power pack to the raceways;

positioning the deployable sensor in the stowed position; and shipping the assembly with the deployable sensor in the stowed position to a facility.

11. The method of claim 10, further wherein the power pack comprises latches for detachably engaging the raceways.

12. The method of claim 10, further comprising:

receiving the assembly at the facility and installing a sensor eye in the sensor head.

13. The method of claim 12, further comprising:

moving the deployable sensor to the deployed position.

14. The method of claim 13, further comprising:

installing the assembly in the facility.

15. The method of claim 10, further comprising:

replacing the deployable sensor by removing the integral assembly of the power pack and the deployable sensor with a replacement integral assembly.

16. A power pack and deployable sensor assembly for a light fixture comprising:

a power pack cover including a latching end, wherein the latching end comprises a flange and a locking protrusion, and further wherein the flange is adapted to mate with an aperture in a raceway and the locking protrusion is adapted to mate with a locking aperture in the raceway such that the power pack cover is detachably mountable to the raceway;

a ballast mounted to the power pack cover, wherein the ballast includes a power input connector adapted to electrically connect to a power cord and a ballast output connector adapted to electrically connect to a lampholder connector; and a deployable sensor movable between a stowed position and a deployed position.

17. The power pack and deployable sensor assembly of claim 16, wherein the deployable sensor comprises a conduit, a sensor head coupled to one end of the conduit, and a pivotable coupling coupled to another end of the conduit and to the power pack to provide a power pack and deployable sensor as a single integrated unit.

18. The power pack and deployable sensor assembly of claim 17, further comprising a bracket mounted on the raceway and operable to receive and retain the conduit when the deployable sensor is in the deployed position.

19. The power pack and deployable sensor assembly of claim 18, wherein the conduit and sensor head are aligned substantially parallel with the power pack and when the conduit and sensor head are in the stowed position.

20. The power pack and deployable sensor assembly of claim 19, wherein the deployed position and the stowed position are substantially axially aligned and 180° apart.

* * * * *